US009864284B2

(12) United States Patent
Kawahara et al.

(10) Patent No.: US 9,864,284 B2
(45) Date of Patent: Jan. 9, 2018

(54) ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masataka Kawahara, Mishima (JP); Hirotoshi Uesugi, Mishima (JP); Akihiro Maruyama, Mishima (JP); Hirofumi Kumoi, Suntou-gun (JP); Masato Tanaka, Tagata-gun (JP); Hiroyuki Tomono, Numazu (JP); Shoma Hinata, Mishima (JP); Yota Ito, Mishima (JP); Daisuke Miura, Tokyo (JP); Takashi Anezaki, Hiratsuka (JP); Tatsuya Yamaai, Yokohama (JP); Kazumichi Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/054,009

(22) Filed: Feb. 25, 2016

(65) Prior Publication Data

US 2016/0252829 A1 Sep. 1, 2016

(30) Foreign Application Priority Data

Feb. 27, 2015 (JP) ..... 2015-039429
Feb. 15, 2016 (JP) ..... 2016-026329

(51) Int. Cl.
*G03G 5/05* (2006.01)
*G03G 5/047* (2006.01)

(52) U.S. Cl.
CPC ..... *G03G 5/0564* (2013.01); *G03G 5/047* (2013.01); *G03G 5/0525* (2013.01); *G03G 5/0592* (2013.01); *G03G 5/0596* (2013.01)

(58) Field of Classification Search
CPC ..... G03G 5/0564; G03G 5/0525
See application file for complete search history.

(56) References Cited

U.S. PATENT DOCUMENTS 4,851,314 A * 7/1989 Yoshihara ..... G03G 5/0564 430/58.05
5,585,212 A * 12/1996 Ueda ..... G03G 5/0618 430/58.05
6,040,099 A * 3/2000 Hanami ..... G03G 5/14756 430/58.2
2002/0025483 A1 * 2/2002 Kawamura ..... G03G 5/047 430/59.6
2010/0209136 A1 8/2010 Mizushima et al.

FOREIGN PATENT DOCUMENTS

JP 61137157 A * 6/1986 ..... G03G 5/0525
JP H04-149557 A 5/1992
JP H05-113680 A 5/1993
JP 06011877 A * 1/1994
JP 06019167 A * 1/1994
JP H06-011877 A 1/1994
JP 06317917 A * 11/1994
JP 2005-338446 A 12/2005
JP 2011-026574 A 2/2011

OTHER PUBLICATIONS

Diamond, Arthur S (editor) Handbook of Imaging Materials. New York: Marcel-Dekker, Inc. (2002) pp. 145-164.*

(Continued)

*Primary Examiner* — Christopher D RoDee
(74) *Attorney, Agent, or Firm* — Canon U.S.A., Inc. IP Division

(57) ABSTRACT

An electrophotographic photosensitive member has a support, a charge generation layer, and a charge transport layer in this order, the charge transport layer containing a charge transport material. The charge transport layer is a surface layer of the electrophotographic photosensitive member and contains a polycarbonate resin having a structural unit selected from group A and a structural unit selected from group B.

7 Claims, 5 Drawing Sheets

(56) References Cited

OTHER PUBLICATIONS

Borsenberger, P.M., Weiss, D.S. Organic Photoreceptors for Imaging Systems. New York: Marcel-Dekker, Inc. (1993) pp. 6-17.*
English language machine translation of JP 61-137157 (Jun. 1986).*
Partial translation of Table 1 in JP 61-137157 (Jun. 1986).*

* cited by examiner

ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a method for manufacturing this electrophotographic photosensitive member, and a process cartridge and an electrophotographic apparatus incorporating this electrophotographic photosensitive member.

Description of the Related Art

Electrophotographic photosensitive members having a charge transport layer as a surface layer are required to be resistant to wear enough to withstand repeated use. To improve the wear resistance of the charge transport layer, researchers have been studying the structure of resins that are used as binders in the charge transport layer, polycarbonate resins in particular (Japanese Patent Laid-Open Nos. 2011-26574, 5-113680, 4-149557, 6-11877, and 2005-338446).

SUMMARY OF THE INVENTION

An aspect of the invention provides an electrophotographic photosensitive member with which fog can be very effectively reduced. Some other aspects of the invention provide a method for manufacturing such an electrophotographic photosensitive member and a process cartridge and an electrophotographic apparatus incorporating such an electrophotographic photosensitive member.

An electrophotographic photosensitive member according to an aspect of the invention has a support, a charge generation layer, and a charge transport layer in this order, the charge transport layer containing a charge transport material. The charge transport layer is a surface layer of the electrophotographic photosensitive member and contains a polycarbonate resin having a structural unit selected from group A and a structural unit selected from group B.

The group A includes structural units represented by formula (103).

(103)

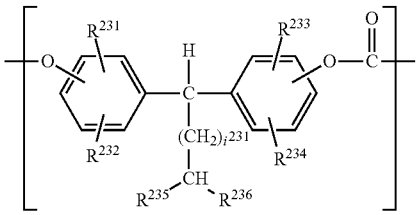

(In formula (103), $R^{231}$ to $R^{234}$ each independently represent a hydrogen atom or an alkyl, aryl, or alkoxy group. $R^{235}$ and $R^{236}$ are groups of the same kind, representing an alkyl group containing 1 to 9 carbon atoms. $i^{231}$ represents an integer of 0 to 3.)

The group B includes structural units represented by formulae (104), (105), and (106).

(104)

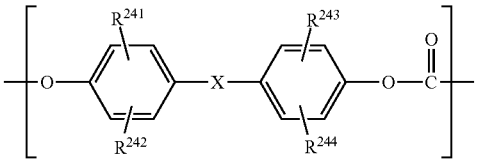

(In formula (104), $R^{241}$ to $R^{244}$ each independently represent a hydrogen atom or an alkyl, aryl, or alkoxy group. X represents a single bond or a sulfonyl group.)

(105)

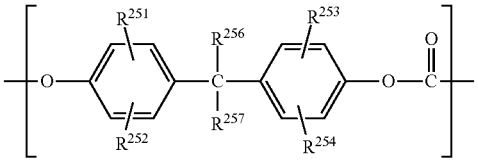

(In formula (105), $R^{251}$ to $R^{254}$ each independently represent a hydrogen atom or an alkyl, aryl, or alkoxy group. $R^{256}$ and $R^{257}$ each independently represent a hydrogen atom or an alkyl, aryl, or halogenated alkyl group.)

(106)

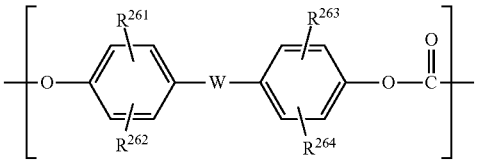

(In formula (106), $R^{261}$ to $R^{264}$ each independently represent a hydrogen atom or an alkyl, aryl, or alkoxy group. W represents a cycloalkylidene group containing 5 to 12 carbon atoms.)

Further features of the present invention will become apparent from the following description of exemplary embodiments with reference to the attached drawings.

DESCRIPTION OF THE EMBODIMENTS

Figure 1:
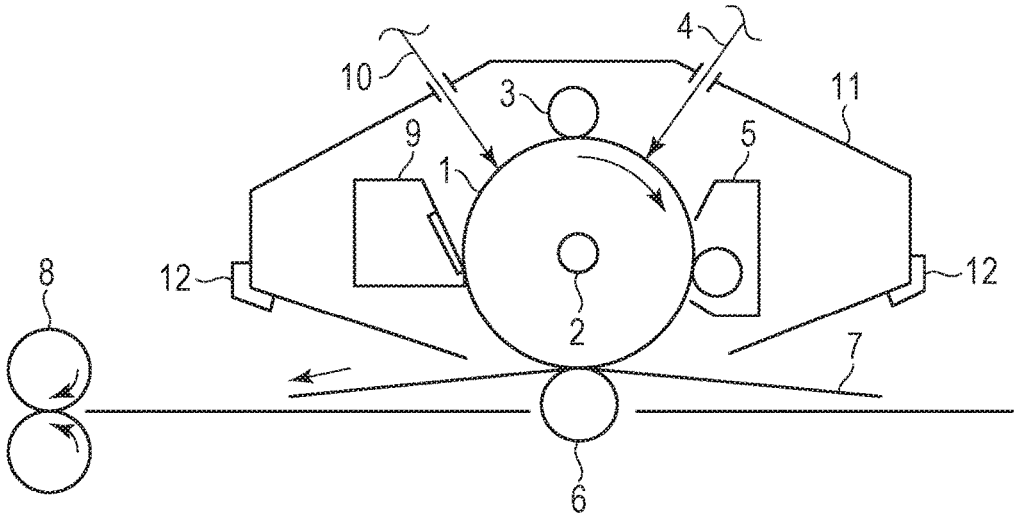
FIG. 1 illustrates an example of a schematic structure of an electrophotographic apparatus installed with a process cartridge that incorporates an electrophotographic photosensitive member.

Through research, the inventors found the following fact. That is, when an electrophotographic photosensitive member having a charge transport layer as a surface layer is used repeatedly, the charge transport layer becomes thinner due to wear. This leads to increased electric field intensity, causing the technical problem called "fog" on images, i.e., a defect whereby a small amount of toner is developed in unintended areas of the images.

The known electrophotographic photosensitive members according to the aforementioned publications, having a charge transport layer that contains a polycarbonate resin as a binder, help to reduce the fog, but not to the extent that the recent high demand for long-life electrophotographic photosensitive members would be fully satisfied.

An aspect of the invention therefore provides an electrophotographic photosensitive member with which fog can be very effectively reduced. Some other aspects of the invention provide a method for manufacturing such an electrophotographic photosensitive member and a process cartridge and an electrophotographic apparatus incorporating such an electrophotographic photosensitive member.

The following describes certain aspects of the invention by providing some preferred embodiments. Studies conducted by the inventors have revealed that the use of a particular kind of polycarbonate resin in a charge transport layer of an electrophotographic photosensitive member significantly improves the mechanical strength of the photosensitive member and leads to effective reduction of fog. To be more specific, an electrophotographic photosensitive member according to an aspect of the invention has a support, a charge generation layer, and a charge transport layer in this order, the charge transport layer containing a charge transport material. The charge transport layer is a surface layer of the electrophotographic photosensitive member and contains a polycarbonate resin having a structural unit selected from group A and a structural unit selected from group B.

The group A includes structural units represented by formula (103).

(103)

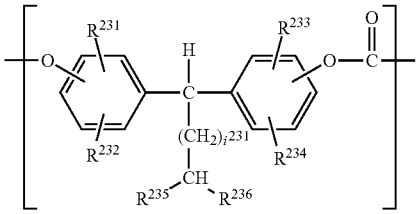

In formula (103), $R^{231}$ to $R^{234}$ each independently represent a hydrogen atom or an alkyl, aryl, or alkoxy group. $R^{235}$ and $R^{236}$ are groups of the same kind, representing a substituted or unsubstituted alkyl group containing 1 to 9 carbon atoms. $i^{231}$ represents an integer of 0 to 3. When $i^{231}$ is 0, this site is a single bond.

The group B includes structural units represented by formulae (104), (105), and (106).

(104)

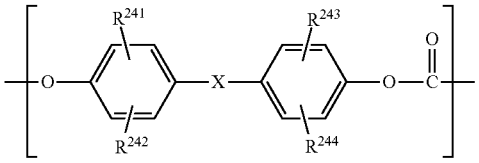

In formula (104), $R^{241}$ to $R^{244}$ each independently represent a hydrogen atom or an alkyl, aryl, or alkoxy group. X represents a single bond or a sulfonyl group.

(105)

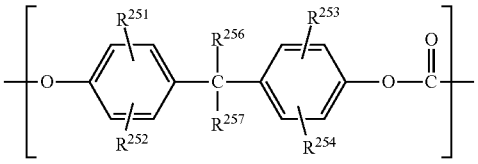

In formula (105), $R^{251}$ to $R^{254}$ each independently represent a hydrogen atom or an alkyl, aryl, or alkoxy group. $R^{256}$ and $R^{257}$ each independently represent a hydrogen atom or an alkyl, aryl, or halogenated alkyl group. The aryl group may be substituted with an alkyl or alkoxy group or a halogen atom.

(106)

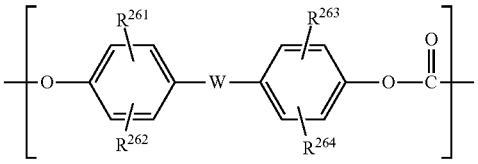

In formula (106), $R^{261}$ to $R^{264}$ each independently represent a hydrogen atom or an alkyl, aryl, or alkoxy group. W represents a cycloalkylidene group containing 5 to 12 carbon atoms. The cycloalkylidene group may be substituted with an alkyl group.

This polycarbonate resin having a structural unit selected from group A and a structural unit selected from group B can be synthesized using, for example, one of the following two processes. The first is to allow a bisphenol compound according to formula (109) and at least one bisphenol compound selected from formulae (110) to (112) to react directly with phosgene (a phosgene process). The second is to transesterify the at least two bisphenol compounds and a bisaryl carbonate, such as diphenyl carbonate, di-p-tolyl carbonate, phenyl-p-tolyl carbonate, di-p-chlorophenyl carbonate, or dinaphthyl carbonate (a transesterification process).

In the phosgene process, the at least two bisphenol compounds and phosgene are usually reacted in the presence of an acid-binding agent and a solvent. The acid-binding agent can be pyridine, an alkali metal hydroxide, such as potassium hydroxide or sodium hydroxide, or similar. The solvent can be methylene chloride, chloroform, or similar. A catalyst and/or a molecular-weight modifier may be added in order to accelerate the condensation polymerization. The catalyst can be triethylamine or any other tertiary amine, a quaternary ammonium salt, or similar. The molecular-weight modifier can be phenol, p-cumylphenol, t-butylphenol, a phenol substituted with a long-chain alkyl group, or similar monofunctional compounds.

The synthesis of the polycarbonate resin may involve an antioxidant, such as sodium sulfite or hydrosulfite, and/or a branching agent, such as phloroglucin or isatin bisphenol. The polycarbonate resin can be synthesized at a temperature of 0° C. to 150° C., preferably 5° C. to 40° C. The duration of the reaction depends on the reaction temperature but can typically be in the range of 0.5 minutes to 10 hours, preferably 1 minute to 2 hours. During the reaction, the pH of the reaction system can be 10 or more.

Here are some specific examples of bisphenol compounds that can be used for synthesis.

(1) A bisphenol compound according to formula (109)

(109)

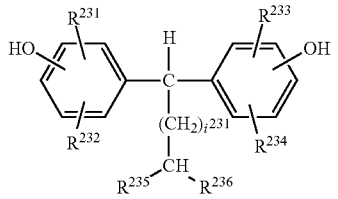

In formula (109), $R^{231}$ to $R^{234}$ each independently represent a hydrogen atom or an alkyl, aryl, or alkoxy group. $R^{235}$ and $R^{236}$ are groups of the same kind, representing a substituted or unsubstituted alkyl group containing 1 to 9 carbon atoms. $i^{231}$ represents an integer of 0 to 3. When $i^{231}$ is 0, this site is a single bond.

Examples of bisphenol compounds represented by general formula (109) include 1,1-bis(4-hydroxyphenyl)-3-methyl butane and 1,1-bis(4-hydroxyphenyl)-2-methyl propane. A combination of two or more of these compounds can also be used.

(2) At least one bisphenol compound selected from formulae (110) to (112)

(110)

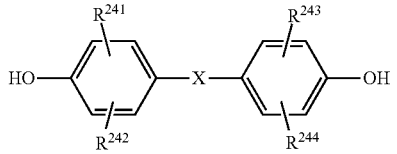

In formula (110), $R^{241}$ to $R^{244}$ each independently represent a hydrogen atom or an alkyl, aryl, or alkoxy group. X represents a single bond or a sulfonyl group.

(111)

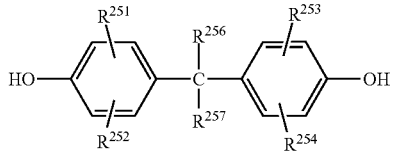

In formula (111), $R^{251}$ to $R^{254}$ each independently represent a hydrogen atom or an alkyl, aryl, or alkoxy group. $R^{256}$ and $R^{257}$ each independently represent a hydrogen atom or an alkyl, aryl, or halogenated alkyl group. The aryl group may be substituted with an alkyl or alkoxy group or a halogen atom.

(112)

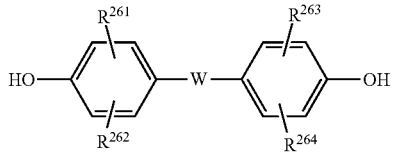

In formula (112), $R^{261}$ to $R^{264}$ each independently represent a hydrogen atom or an alkyl, aryl, or alkoxy group. W represents a cycloalkylidene group containing 5 to 12 carbon atoms. The cycloalkylidene group may be substituted with an alkyl group.

Examples of bisphenol compounds represented by formulae (110) to (112) include 4,4'-dihydroxybiphenyl, 4,4'-dihydroxy-3,3'-dimethyl biphenyl, 4,4'-dihydroxy-2,2'-dimethyl biphenyl, 4,4'-dihydroxy-3,3',5-trimethyl biphenyl, 4,4'-dihydroxy-3,3',5,5'-tetramethyl biphenyl, 4,4'-dihydroxy-3,3'-dibutyl biphenyl, 4,4'-dihydroxy-3,3'-dicyclohexyl biphenyl, 3,3'-difluoro-4,4'-dihydroxybiphenyl, 4,4'-dihydroxy-3,3'-diphenyl biphenyl, 1,1-bis(4-hydroxyphenyl)ethane, 1,1-bis(3-methyl-4-hydroxyphenyl) ethane, 1,1-bis(3-fluoro-4-hydroxyphenyl)ethane, 1,1-bis(2-tert-butyl-4-hydroxy-3-methyl phenyl)ethane, 1,2-bis(4-hydroxyphenyl)ethane, 1,2-bis(3-methyl-4-hydroxyphenyl) ethane, 2,2-bis(4-hydroxyphenyl)propane, 2,2-bis(3-methyl-4-hydroxyphenyl)propane, 2,2-bis(3-cyclohexyl-4-hydroxyphenyl)propane, 2,2-bis(3-phenyl-4-hydroxyphenyl)propane, 2,2-bis(3,5-dimethyl-4-hydroxyphenyl)propane, 2,2-bis(3-fluoro-4-hydroxyphenyl) propane, 2,2-bis(3-chloro-4-hydroxyphenyl)propane, 2,2-bis(3-bromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl)propane, 2,2-bis(2-tert-butyl-4-hydroxy-3-methyl phenyl)propane, 2,2-bis(4-hydroxyphenyl) hexafluoropropane, 2,2-bis(3-methyl-4-hydroxyphenyl) hexafluoropropane, 2,2-bis(3,5-dimethyl-4-hydroxyphenyl) hexafluoropropane, 2,2-bis(3-phenyl-4-hydroxyphenyl) hexafluoropropane, 2,2-bis(3-fluoro-4-hydroxyphenyl) hexafluoropropane, 2,2-bis(3-chloro-4-hydroxyphenyl) hexafluoropropane, 1,1-bis(4-hydroxyphenyl)cyclohexane, 1,1-bis(3-methyl-4-hydroxyphenyl)cyclohexane, 1,1-bis(3-cyclo-4-hydroxyphenyl)cyclohexane, 1,1-bis(3-phenyl-4-hydroxyphenyl)cyclohexane, 1,1-bis(3,5-dimethyl-4-hydroxyphenyl)cyclohexane, 1,1-bis(3-fluoro-4-hydroxyphenyl)cyclohexane, 1,1-bis(3-chloro-4-hydroxyphenyl)cyclohexane, 1,1-bis(3-bromo-4-hydroxyphenyl)cyclohexane, 1,1-bis(3,5-difluoro-4-hydroxyphenyl)cyclohexane, 1,1-bis(3,5-dichloro-4-hydroxyphenyl)cyclohexane, 1,1-bis(3,5-dibromo-4-hydroxyphenyl)cyclohexane, 1,1-bis(2-tert-butyl-4-hydroxy-3-methyl phenyl)cyclohexane, bis(4-hydroxyphenyl)sulfone, 1,1-bis(4-hydroxyphenyl)-3,3,5-trimethyl cyclohexane, 1,1-bis(4-hydroxyphenyl) cyclopentane, 1,1-bis(4-hydroxyphenyl)-1-phenyl ethane, bis(4-hydroxyphenyl)diphenyl methane, 9,9-bis(4-hydroxyphenyl)-fluorene, and 2,2-bis(4-hydroxyphenyl)butane. A combination of two or more of these compounds can also be used.

Structural Unit Selected from Group A

The use of a polycarbonate resin having any of the structural units represented by formulae (A-301) to (A-305), as compared to others selected from group A, leads to more effective reduction of fog and better electrical characteristics. Polycarbonate resins having any of these structural units, while in the charge transport layer, will keep a constant intermolecular distance and a constant distance from the charge transport material, improving mechanical strength and electrical characteristics.

(A-301)

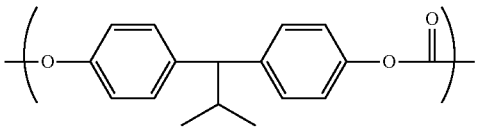

(A-302)

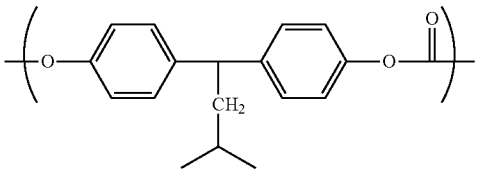

(A-303)

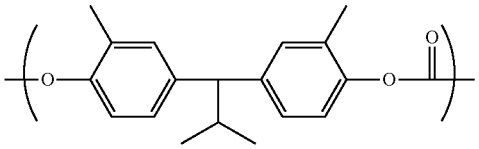

(A-304)

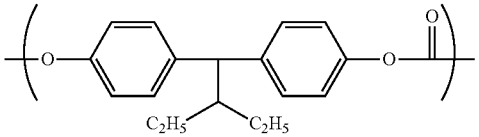

(A-305)

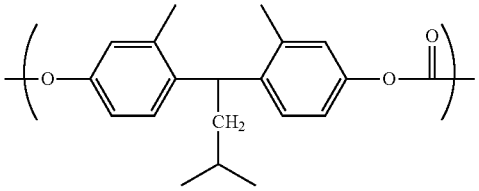

Structural Unit Selected from Group B

The use of a polycarbonate resin having any of the structural units represented by formulae (B-103) and (B-110) to (B-112), as compared to others selected from group B, leads to more effective reduction of fog and better electrical characteristics. Polycarbonate resins having any of these structural units, while in the charge transport layer, will keep a constant intermolecular distance and a constant distance from the charge transport material, improving mechanical strength and electrical characteristics.

(B-103)

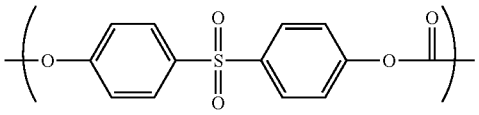

(B-110)

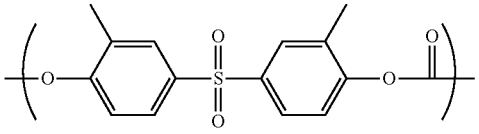

-continued (B-111)

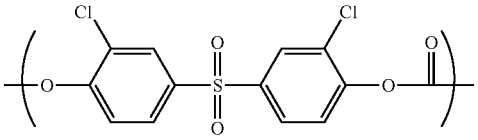

(B-112)

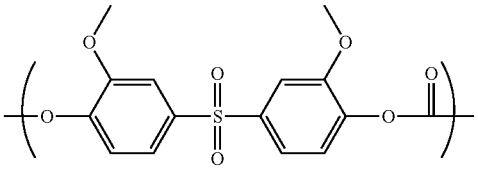

The use of a polycarbonate resin having any of the structural units represented by formulae (B-201) to (B-205), as compared to others selected from group B, leads to more effective reduction of fog. Polycarbonate resins having any of these structural units will be, while in the charge transport layer, densely packed with short intermolecular distances, improving mechanical strength.

(B-201)

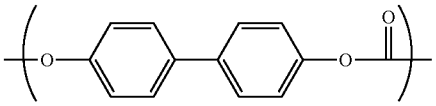

(B-202)

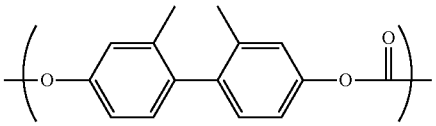

(B-203)

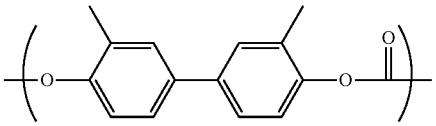

(B-204)

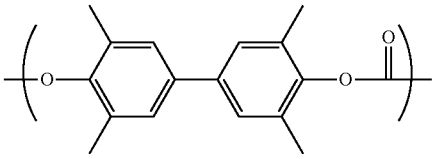

(B-205)

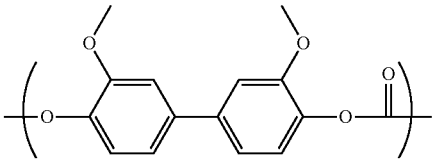

The use of a polycarbonate resin having any of the structural units represented by (B-301) to (B-308), as compared to others selected from group B, is effective in improving the storage stability of the coating liquid for the formation of the charge transport layer, the prevention of photomemories, and electrical characteristics after repeated use. Polycarbonate resins having any of these structural units will exhibit improved solubility in the solvent of the coating liquid for the formation of the charge transport layer. Furthermore, polycarbonate resins having any of these structural units, while in the charge transport layer, will keep a constant distance from the charge transport material, improving electrical characteristics. A photomemory is a defect caused by the retention of light-generated carriers in a photosensitive layer of an electrophotographic photosensitive member and occurs when an electrophotographic photosensitive member is exposed to light, such as from a fluorescent lamp, in association with maintenance of a process cartridge or electrophotographic apparatus after repeated use. If an electrophotographic photosensitive member in this state is used to produce an image, the difference in electrical potential between the exposed and unexposed areas appears as uneven density in the resulting image.

The use of a polycarbonate resin having any of the structural units represented by (B-401) to (B-405), as compared to others selected from group B, is effective in improving the storage stability of the coating liquid for the formation of the charge transport layer, the prevention of photomemories, and electrical characteristics after repeated use. Polycarbonate resins having any of these structural units will exhibit improved solubility in the solvent of the coating liquid for the formation of the charge transport layer. Furthermore, polycarbonate resins having any of these structural units, while in the charge transport layer, will keep a constant distance from the charge transport material, improving electrical characteristics.

(B-301)

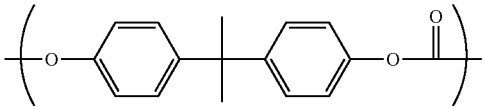

(B-302)

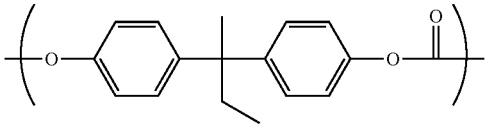

(B-303)

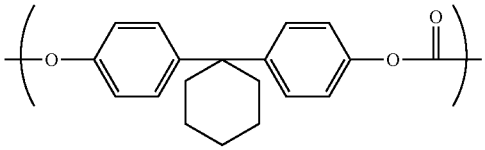

(B-304)

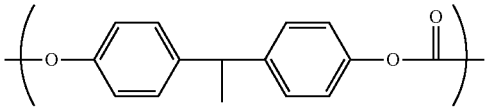

(B-305)

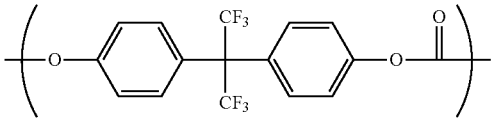

(B-306)

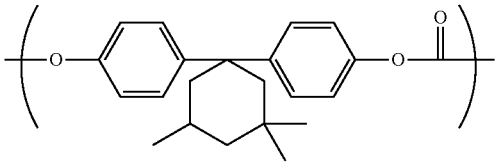

(B-307)

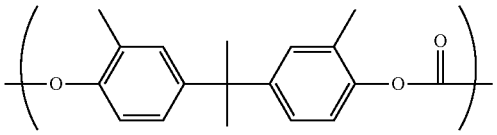

(B-308)

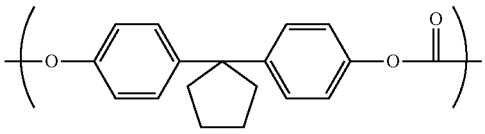

(B-401)

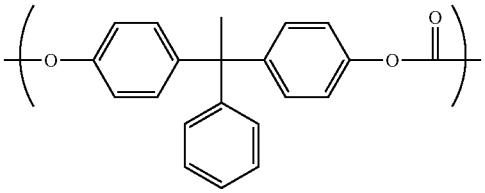

(B-402)

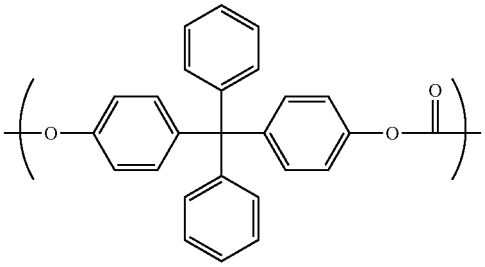

(B-403)

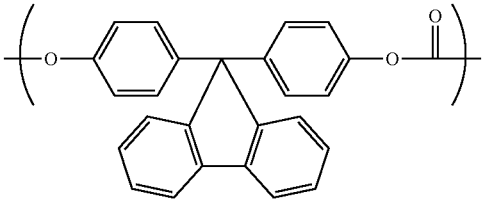

(B-404)

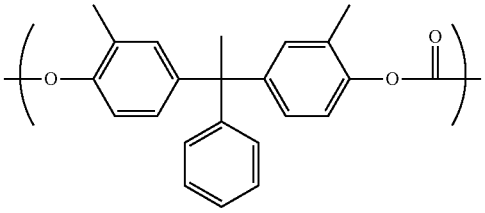

(B-405)

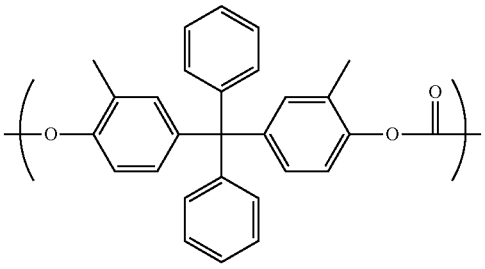

The proportion of the structural unit selected from group A in the polycarbonate resin can be 20 mol % or more and 70 mol % or less, preferably 25 mol % or more and 49 mol % or less.

In an embodiment of the invention, the weight-average molecular weight (Mw) of the polycarbonate resin can be 30,000 or more and 100,000 or less, preferably 40,000 or more and 80,000 or less. If the weight-average molecular weight of the polycarbonate resin is less than 30,000, the reduction of fog may be insufficient due to low mechanical strength. If the weight-average molecular weight of the polycarbonate resin is more than 100,000, the coating liquid for the formation of the charge transport layer may lack storage stability. In Examples below, the weight-average molecular weights of the resins are polystyrene equivalents measured using gel permeation chromatography (GPC) [on Alliance HPLC system (Waters)] under the following conditions: two Shodex KF-805L columns (Showa Denko), 0.25 w/v % chloroform solution as sample, chloroform at 1 ml/min as eluent, and UV detection at 254 nm.

The intrinsic viscosity of the polycarbonate resin can be in the range of 0.3 dL/g to 2.0 dL/g.

The relative dielectric constant $\in$ of a polycarbonate resin can be determined according to the Clausius-Mossotti equation that follows.

$$K=(4\pi/3)\times(\alpha/V)$$

$$\in=(1+2K)/(1-K)$$

In this equation, V is the volume of the molecule in its stable structure obtained after structural optimization using density functional calculations B3LYP/6-31G(d,p), and $\alpha$ is the polarizability according to a restricted Hartree-Fock calculation (using the basis function 6-31G(d,p)) in this post-optimization stable structure. For polycarbonate resins having multiple structural units (e.g., copolymers), the relative dielectric constant values of the individual structural units multiplied by their respective proportions are totaled up. For example, exemplified compound 1921 has relative dielectric constant values of 2.11 and 2.20 in structural units (A-301) and (B-301), respectively. The relative dielectric constant of exemplified compound 1921 is therefore 2.16 based on the proportions of the structural units. In an embodiment of the invention, the relative dielectric constant $\in$ can be 2.15 or less, preferably 2.13 or less.

A relative dielectric constant of 2.15 or less leads to better response at high speeds, presumably for the following reason. The term "response at high speeds" means that the density of an image produced is comparable between normal and faster process speeds in the image formation process. Altering the process speed usually leads to a change in the amount of light the electrophotographic photosensitive member receives. Even if the amount of light is controlled to achieve constant light exposure of the electrophotographic photosensitive member, different process speeds can result in different image densities. This difference in density becomes more significant in faster processes because the time from exposure to development shortens with increasing process speed. One cause is reciprocal failure, which necessitates complicated control in order to equalize the image density. The inventors, however, presume that reciprocal failure is not the only cause. Another cause is, in the opinion of the inventors, a difference in the rate of light decay of the surface potential of the electrophotographic photosensitive member that occurs during development, a stage in the exposure and development process the electrophotographic photosensitive member undergoes to form an image. To be more specific, even if the electrophotographic photosensitive member has equal surface potentials at the time of development, a difference in the rate of light decay of its surface potential will lead to a difference in the ability of the photosensitive member to develop toner, resulting in variations in density between the images produced. Charge generated in a charge generation layer is injected into a charge transport layer and then is transported to the surface of the electrophotographic photosensitive member by travelling in the charge transport layer. Some amount of charge reaches the surface of the electrophotographic photosensitive member in a short time, but some other amount of charge requires a relatively long time to arrive (residual charge). In view of the fact that the light decay during development occurs immediately after the photoresponse in the charging and exposure process, the rate of light decay should be influenced by the behavior of charge carriers in the charge transport layer toward the residual charge at low electric-field intensity. When the relative dielectric constant of the polycarbonate resin is 2.15 or less, the electrophotographic photosensitive member will not greatly change its capacity to put out residual charge at low electric-field intensity over time, and its rate of light decay during development will therefore be low. Furthermore, the inventors believe that when the relative dielectric constant of the polycarbonate resin is 2.15 or less, the ability of the electrophotographic photosensitive member to develop toner is not very sensitive to unevenness in the surface potential of the electrophotographic photosensitive member, and the density of an image produced is thus comparable between normal and faster process speeds in the image formation process.

When the relative dielectric constant of the polycarbonate resin is 2.15 or less, moreover, the intensity of an electric field applied to the charge transport layer will act favorably on the transport of charge through the charge transport layer and the injection of charge from a charge generation layer into the charge transport layer, making the electrophotographic photosensitive member excellent in terms of the prevention of photomemories after repeated use.

Specific Examples of Polycarbonate Resins

Tables 1 to 3 present specific examples of polycarbonate resins having a structural unit selected from group A and a structural unit selected from group B, along with their relative dielectric constant values.

TABLE 1

Specific examples of polycarbonate resins

| | Group A | | Group B | | |
|---|---|---|---|---|---|
| Exemplified compound No. | Structural unit | Proportion (mol %) | Structural unit | Proportion (mol %) | Dielectric constant |
| Exemplified compound 1921 | A-301 | 49 | B-201 | 51 | 2.16 |
| Exemplified compound 1922 | A-301 | 80 | B-201 | 20 | 2.13 |

TABLE 1-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 1923 | A-301 | 35 | B-201 | 65 | 2.17 |
| Exemplified compound 1924 | A-301 | 20 | B-201 | 80 | 2.18 |
| Exemplified compound 1925 | A-301 | 49 | B-202 | 51 | 2.10 |
| Exemplified compound 1926 | A-301 | 80 | B-202 | 20 | 2.11 |
| Exemplified compound 1927 | A-301 | 35 | B-202 | 65 | 2.10 |
| Exemplified compound 1928 | A-301 | 20 | B-202 | 80 | 2.09 |
| Exemplified compound 1929 | A-301 | 49 | B-203 | 51 | 2.13 |
| Exemplified compound 1930 | A-301 | 80 | B-203 | 20 | 2.12 |
| Exemplified compound 1931 | A-301 | 35 | B-203 | 65 | 2.14 |
| Exemplified compound 1932 | A-301 | 20 | B-203 | 80 | 2.14 |
| Exemplified compound 1933 | A-301 | 49 | B-204 | 51 | 2.09 |
| Exemplified compound 1934 | A-301 | 80 | B-204 | 20 | 2.11 |
| Exemplified compound 1935 | A-301 | 35 | B-204 | 65 | 2.09 |
| Exemplified compound 1936 | A-301 | 20 | B-204 | 80 | 2.08 |
| Exemplified compound 1937 | A-301 | 49 | B-205 | 51 | 2.13 |
| Exemplified compound 1938 | A-301 | 80 | B-205 | 20 | 2.12 |
| Exemplified compound 1939 | A-301 | 35 | B-205 | 65 | 2.14 |
| Exemplified compound 1940 | A-301 | 20 | B-205 | 80 | 2.14 |
| Exemplified compound 1941 | A-301 | 49 | B-301 | 51 | 2.12 |
| Exemplified compound 1942 | A-301 | 80 | B-301 | 20 | 2.12 |
| Exemplified compound 1943 | A-301 | 35 | B-301 | 65 | 2.13 |
| Exemplified compound 1944 | A-301 | 20 | B-301 | 80 | 2.13 |
| Exemplified compound 1945 | A-301 | 49 | B-302 | 51 | 2.12 |
| Exemplified compound 1946 | A-301 | 80 | B-302 | 20 | 2.12 |
| Exemplified compound 1947 | A-301 | 35 | B-302 | 65 | 2.12 |
| Exemplified compound 1948 | A-301 | 20 | B-302 | 80 | 2.13 |
| Exemplified compound 1949 | A-301 | 49 | B-303 | 51 | 2.13 |
| Exemplified compound 1950 | A-301 | 80 | B-303 | 20 | 2.12 |
| Exemplified compound 1951 | A-301 | 35 | B-303 | 65 | 2.14 |
| Exemplified compound 1952 | A-301 | 20 | B-303 | 80 | 2.14 |
| Exemplified compound 1953 | A-301 | 49 | B-304 | 51 | 2.13 |
| Exemplified compound 1954 | A-301 | 80 | B-304 | 20 | 2.12 |
| Exemplified compound 1955 | A-301 | 35 | B-304 | 65 | 2.13 |
| Exemplified compound 1956 | A-301 | 20 | B-304 | 80 | 2.13 |
| Exemplified compound 1957 | A-301 | 49 | B-305 | 51 | 2.07 |
| Exemplified compound 1958 | A-301 | 80 | B-305 | 20 | 2.10 |
| Exemplified compound 1959 | A-301 | 35 | B-305 | 65 | 2.06 |
| Exemplified compound 1960 | A-301 | 20 | B-305 | 80 | 2.05 |
| Exemplified compound 1961 | A-301 | 49 | B-306 | 51 | 2.14 |
| Exemplified compound 1962 | A-301 | 80 | B-306 | 20 | 2.12 |
| Exemplified compound 1963 | A-301 | 35 | B-306 | 65 | 2.15 |
| Exemplified compound 1964 | A-301 | 20 | B-306 | 80 | 2.15 |
| Exemplified compound 1965 | A-301 | 49 | B-307 | 51 | 2.12 |
| Exemplified compound 1966 | A-301 | 80 | B-307 | 20 | 2.12 |
| Exemplified compound 1967 | A-301 | 35 | B-307 | 65 | 2.12 |
| Exemplified compound 1968 | A-301 | 20 | B-307 | 80 | 2.13 |
| Exemplified compound 1969 | A-301 | 49 | B-308 | 51 | 2.13 |
| Exemplified compound 1970 | A-301 | 80 | B-308 | 20 | 2.12 |
| Exemplified compound 1971 | A-301 | 35 | B-308 | 65 | 2.14 |
| Exemplified compound 1972 | A-301 | 20 | B-308 | 80 | 2.14 |
| Exemplified compound 1973 | A-301 | 49 | B-401 | 51 | 2.17 |
| Exemplified compound 1974 | A-301 | 80 | B-401 | 20 | 2.13 |
| Exemplified compound 1975 | A-301 | 35 | B-401 | 65 | 2.18 |
| Exemplified compound 1976 | A-301 | 20 | B-401 | 80 | 2.20 |
| Exemplified compound 1977 | A-301 | 49 | B-402 | 51 | 2.21 |
| Exemplified compound 1978 | A-301 | 80 | B-402 | 20 | 2.15 |
| Exemplified compound 1979 | A-301 | 35 | B-402 | 65 | 2.23 |
| Exemplified compound 1980 | A-301 | 20 | B-402 | 80 | 2.26 |
| Exemplified compound 1981 | A-301 | 49 | B-403 | 51 | 2.26 |
| Exemplified compound 1982 | A-301 | 80 | B-403 | 20 | 2.17 |
| Exemplified compound 1983 | A-301 | 35 | B-403 | 65 | 2.30 |
| Exemplified compound 1984 | A-301 | 20 | B-403 | 80 | 2.35 |
| Exemplified compound 1985 | A-301 | 49 | B-404 | 51 | 2.14 |
| Exemplified compound 1986 | A-301 | 80 | B-404 | 20 | 2.12 |
| Exemplified compound 1987 | A-301 | 35 | B-404 | 65 | 2.15 |
| Exemplified compound 1988 | A-301 | 20 | B-404 | 80 | 2.16 |
| Exemplified compound 1989 | A-301 | 49 | B-405 | 51 | 2.20 |
| Exemplified compound 1990 | A-301 | 80 | B-405 | 20 | 2.15 |
| Exemplified compound 1991 | A-301 | 35 | B-405 | 65 | 2.23 |
| Exemplified compound 1992 | A-301 | 20 | B-405 | 80 | 2.25 |
| Exemplified compound 1993 | A-302 | 49 | B-201 | 51 | 2.14 |
| Exemplified compound 1994 | A-302 | 80 | B-201 | 20 | 2.09 |
| Exemplified compound 1995 | A-302 | 35 | B-201 | 65 | 2.15 |

TABLE 1-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 1996 | A-302 | 20 | B-201 | 80 | 2.17 |
| Exemplified compound 1997 | A-302 | 49 | B-202 | 51 | 2.08 |
| Exemplified compound 1998 | A-302 | 80 | B-202 | 20 | 2.07 |
| Exemplified compound 1999 | A-302 | 35 | B-202 | 65 | 2.08 |
| Exemplified compound 2000 | A-302 | 20 | B-202 | 80 | 2.09 |
| Exemplified compound 2001 | A-302 | 49 | B-203 | 51 | 2.11 |
| Exemplified compound 2002 | A-302 | 80 | B-203 | 20 | 2.08 |
| Exemplified compound 2003 | A-302 | 35 | B-203 | 65 | 2.12 |
| Exemplified compound 2004 | A-302 | 20 | B-203 | 80 | 2.14 |
| Exemplified compound 2005 | A-302 | 49 | B-204 | 51 | 2.07 |
| Exemplified compound 2006 | A-302 | 80 | B-204 | 20 | 2.07 |
| Exemplified compound 2007 | A-302 | 35 | B-204 | 65 | 2.07 |
| Exemplified compound 2008 | A-302 | 20 | B-204 | 80 | 2.07 |
| Exemplified compound 2009 | A-302 | 49 | B-205 | 51 | 2.11 |
| Exemplified compound 2010 | A-302 | 80 | B-205 | 20 | 2.08 |
| Exemplified compound 2011 | A-302 | 35 | B-205 | 65 | 2.12 |
| Exemplified compound 2012 | A-302 | 20 | B-205 | 80 | 2.13 |
| Exemplified compound 2013 | A-302 | 49 | B-301 | 51 | 2.10 |
| Exemplified compound 2014 | A-302 | 80 | B-301 | 20 | 2.08 |
| Exemplified compound 2015 | A-302 | 35 | B-301 | 65 | 2.11 |
| Exemplified compound 2016 | A-302 | 20 | B-301 | 80 | 2.12 |
| Exemplified compound 2017 | A-302 | 49 | B-302 | 51 | 2.10 |
| Exemplified compound 2018 | A-302 | 80 | B-302 | 20 | 2.08 |
| Exemplified compound 2019 | A-302 | 35 | B-302 | 65 | 2.11 |
| Exemplified compound 2020 | A-302 | 20 | B-302 | 80 | 2.12 |
| Exemplified compound 2021 | A-302 | 49 | B-303 | 51 | 2.11 |
| Exemplified compound 2022 | A-302 | 80 | B-303 | 20 | 2.08 |
| Exemplified compound 2023 | A-302 | 35 | B-303 | 65 | 2.12 |
| Exemplified compound 2024 | A-302 | 20 | B-303 | 80 | 2.13 |
| Exemplified compound 2025 | A-302 | 49 | B-304 | 51 | 2.10 |
| Exemplified compound 2026 | A-302 | 80 | B-304 | 20 | 2.08 |
| Exemplified compound 2027 | A-302 | 35 | B-304 | 65 | 2.11 |
| Exemplified compound 2028 | A-302 | 20 | B-304 | 80 | 2.13 |
| Exemplified compound 2029 | A-302 | 49 | B-305 | 51 | 2.05 |
| Exemplified compound 2030 | A-302 | 80 | B-305 | 20 | 2.06 |
| Exemplified compound 2031 | A-302 | 35 | B-305 | 65 | 2.05 |
| Exemplified compound 2032 | A-302 | 20 | B-305 | 80 | 2.04 |
| Exemplified compound 2033 | A-302 | 49 | B-306 | 51 | 2.12 |
| Exemplified compound 2034 | A-302 | 80 | B-306 | 20 | 2.09 |
| Exemplified compound 2035 | A-302 | 35 | B-306 | 65 | 2.13 |
| Exemplified compound 2036 | A-302 | 20 | B-306 | 80 | 2.14 |
| Exemplified compound 2037 | A-302 | 49 | B-307 | 51 | 2.10 |
| Exemplified compound 2038 | A-302 | 80 | B-307 | 20 | 2.08 |
| Exemplified compound 2039 | A-302 | 35 | B-307 | 65 | 2.11 |
| Exemplified compound 2040 | A-302 | 20 | B-307 | 80 | 2.12 |

TABLE 2

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2040 | A-302 | 20 | B-307 | 80 | 2.12 |
| Exemplified compound 2041 | A-302 | 49 | B-308 | 51 | 2.11 |
| Exemplified compound 2042 | A-302 | 80 | B-308 | 20 | 2.08 |
| Exemplified compound 2043 | A-302 | 35 | B-308 | 65 | 2.12 |
| Exemplified compound 2044 | A-302 | 20 | B-308 | 80 | 2.13 |
| Exemplified compound 2045 | A-302 | 49 | B-401 | 51 | 2.14 |
| Exemplified compound 2046 | A-302 | 80 | B-401 | 20 | 2.10 |
| Exemplified compound 2047 | A-302 | 35 | B-401 | 65 | 2.17 |
| Exemplified compound 2048 | A-302 | 20 | B-401 | 80 | 2.19 |
| Exemplified compound 2049 | A-302 | 49 | B-402 | 51 | 2.19 |
| Exemplified compound 2050 | A-302 | 80 | B-402 | 20 | 2.11 |
| Exemplified compound 2051 | A-302 | 35 | B-402 | 65 | 2.22 |
| Exemplified compound 2052 | A-302 | 20 | B-402 | 80 | 2.25 |
| Exemplified compound 2053 | A-302 | 49 | B-403 | 51 | 2.24 |
| Exemplified compound 2054 | A-302 | 80 | B-403 | 20 | 2.13 |

TABLE 2-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 2055 | A-302 | 35 | B-403 | 65 | 2.29 |
| Exemplified compound 2056 | A-302 | 20 | B-403 | 80 | 2.34 |
| Exemplified compound 2057 | A-302 | 49 | B-404 | 51 | 2.12 |
| Exemplified compound 2058 | A-302 | 80 | B-404 | 20 | 2.09 |
| Exemplified compound 2059 | A-302 | 35 | B-404 | 65 | 2.13 |
| Exemplified compound 2060 | A-302 | 20 | B-404 | 80 | 2.15 |
| Exemplified compound 2061 | A-302 | 49 | B-405 | 51 | 2.18 |
| Exemplified compound 2062 | A-302 | 80 | B-405 | 20 | 2.11 |
| Exemplified compound 2063 | A-302 | 35 | B-405 | 65 | 2.21 |
| Exemplified compound 2064 | A-302 | 20 | B-405 | 80 | 2.24 |
| Exemplified compound 2065 | A-303 | 49 | B-201 | 51 | 2.12 |
| Exemplified compound 2066 | A-303 | 80 | B-201 | 20 | 2.06 |
| Exemplified compound 2067 | A-303 | 35 | B-201 | 65 | 2.14 |
| Exemplified compound 2068 | A-303 | 20 | B-201 | 80 | 2.17 |
| Exemplified compound 2069 | A-303 | 49 | B-202 | 51 | 2.06 |
| Exemplified compound 2070 | A-303 | 80 | B-202 | 20 | 2.04 |
| Exemplified compound 2071 | A-303 | 35 | B-202 | 65 | 2.07 |
| Exemplified compound 2072 | A-303 | 20 | B-202 | 80 | 2.08 |
| Exemplified compound 2073 | A-303 | 49 | B-203 | 51 | 2.09 |
| Exemplified compound 2074 | A-303 | 80 | B-203 | 20 | 2.05 |
| Exemplified compound 2075 | A-303 | 35 | B-203 | 65 | 2.11 |
| Exemplified compound 2076 | A-303 | 20 | B-203 | 80 | 2.13 |
| Exemplified compound 2077 | A-303 | 49 | B-204 | 51 | 2.05 |
| Exemplified compound 2078 | A-303 | 80 | B-204 | 20 | 2.04 |
| Exemplified compound 2079 | A-303 | 35 | B-204 | 65 | 2.06 |
| Exemplified compound 2080 | A-303 | 20 | B-204 | 80 | 2.07 |
| Exemplified compound 2081 | A-303 | 49 | B-205 | 51 | 2.09 |
| Exemplified compound 2082 | A-303 | 80 | B-205 | 20 | 2.05 |
| Exemplified compound 2083 | A-303 | 35 | B-205 | 65 | 2.11 |
| Exemplified compound 2084 | A-303 | 20 | B-205 | 80 | 2.13 |
| Exemplified compound 2085 | A-303 | 49 | B-301 | 51 | 2.08 |
| Exemplified compound 2086 | A-303 | 80 | B-301 | 20 | 2.05 |
| Exemplified compound 2087 | A-303 | 35 | B-301 | 65 | 2.10 |
| Exemplified compound 2088 | A-303 | 20 | B-301 | 80 | 2.11 |
| Exemplified compound 2089 | A-303 | 49 | B-302 | 51 | 2.08 |
| Exemplified compound 2090 | A-303 | 80 | B-302 | 20 | 2.05 |
| Exemplified compound 2091 | A-303 | 35 | B-302 | 65 | 2.10 |
| Exemplified compound 2092 | A-303 | 20 | B-302 | 80 | 2.11 |
| Exemplified compound 2093 | A-303 | 49 | B-303 | 51 | 2.09 |
| Exemplified compound 2094 | A-303 | 80 | B-303 | 20 | 2.05 |
| Exemplified compound 2095 | A-303 | 35 | B-303 | 65 | 2.11 |
| Exemplified compound 2096 | A-303 | 20 | B-303 | 80 | 2.13 |
| Exemplified compound 2097 | A-303 | 49 | B-304 | 51 | 2.09 |
| Exemplified compound 2098 | A-303 | 80 | B-304 | 20 | 2.05 |
| Exemplified compound 2099 | A-303 | 35 | B-304 | 65 | 2.10 |
| Exemplified compound 2100 | A-303 | 20 | B-304 | 80 | 2.12 |
| Exemplified compound 2101 | A-303 | 49 | B-305 | 51 | 2.03 |
| Exemplified compound 2102 | A-303 | 80 | B-305 | 20 | 2.03 |
| Exemplified compound 2103 | A-303 | 35 | B-305 | 65 | 2.03 |
| Exemplified compound 2104 | A-303 | 20 | B-305 | 80 | 2.03 |
| Exemplified compound 2105 | A-303 | 49 | B-306 | 51 | 2.10 |
| Exemplified compound 2106 | A-303 | 80 | B-306 | 20 | 2.06 |
| Exemplified compound 2107 | A-303 | 35 | B-306 | 65 | 2.12 |
| Exemplified compound 2108 | A-303 | 20 | B-306 | 80 | 2.14 |
| Exemplified compound 2109 | A-303 | 49 | B-307 | 51 | 2.08 |
| Exemplified compound 2110 | A-303 | 80 | B-307 | 20 | 2.05 |
| Exemplified compound 2111 | A-303 | 35 | B-307 | 65 | 2.09 |
| Exemplified compound 2112 | A-303 | 20 | B-307 | 80 | 2.11 |
| Exemplified compound 2113 | A-303 | 49 | B-308 | 51 | 2.09 |
| Exemplified compound 2114 | A-303 | 80 | B-308 | 20 | 2.05 |
| Exemplified compound 2115 | A-303 | 35 | B-308 | 65 | 2.11 |
| Exemplified compound 2116 | A-303 | 20 | B-308 | 80 | 2.12 |
| Exemplified compound 2117 | A-303 | 49 | B-401 | 51 | 2.13 |
| Exemplified compound 2118 | A-303 | 80 | B-401 | 20 | 2.07 |
| Exemplified compound 2119 | A-303 | 35 | B-401 | 65 | 2.15 |
| Exemplified compound 2120 | A-303 | 20 | B-401 | 80 | 2.18 |
| Exemplified compound 2121 | A-303 | 49 | B-402 | 51 | 2.17 |
| Exemplified compound 2122 | A-303 | 80 | B-402 | 20 | 2.08 |
| Exemplified compound 2123 | A-303 | 35 | B-402 | 65 | 2.21 |
| Exemplified compound 2124 | A-303 | 20 | B-402 | 80 | 2.25 |
| Exemplified compound 2125 | A-303 | 49 | B-403 | 51 | 2.22 |
| Exemplified compound 2126 | A-303 | 80 | B-403 | 20 | 2.10 |
| Exemplified compound 2127 | A-303 | 35 | B-403 | 65 | 2.27 |

TABLE 2-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2128 | A-303 | 20 | B-403 | 80 | 2.33 |
| Exemplified compound 2129 | A-303 | 49 | B-404 | 51 | 2.10 |
| Exemplified compound 2130 | A-303 | 80 | B-404 | 20 | 2.06 |
| Exemplified compound 2131 | A-303 | 35 | B-404 | 65 | 2.12 |
| Exemplified compound 2132 | A-303 | 20 | B-404 | 80 | 2.14 |
| Exemplified compound 2133 | A-303 | 49 | B-405 | 51 | 2.16 |
| Exemplified compound 2134 | A-303 | 80 | B-405 | 20 | 2.08 |
| Exemplified compound 2135 | A-303 | 35 | B-405 | 65 | 2.20 |
| Exemplified compound 2136 | A-303 | 20 | B-405 | 80 | 2.24 |
| Exemplified compound 2137 | A-304 | 49 | B-201 | 51 | 2.14 |
| Exemplified compound 2138 | A-304 | 80 | B-201 | 20 | 2.11 |
| Exemplified compound 2139 | A-304 | 35 | B-201 | 65 | 2.16 |
| Exemplified compound 2140 | A-304 | 20 | B-201 | 80 | 2.18 |
| Exemplified compound 2141 | A-304 | 49 | B-202 | 51 | 2.09 |
| Exemplified compound 2142 | A-304 | 80 | B-202 | 20 | 2.08 |
| Exemplified compound 2143 | A-304 | 35 | B-202 | 65 | 2.09 |
| Exemplified compound 2144 | A-304 | 20 | B-202 | 80 | 2.09 |
| Exemplified compound 2145 | A-304 | 49 | B-203 | 51 | 2.12 |
| Exemplified compound 2146 | A-304 | 80 | B-203 | 20 | 2.10 |
| Exemplified compound 2147 | A-304 | 35 | B-203 | 65 | 2.13 |
| Exemplified compound 2148 | A-304 | 20 | B-203 | 80 | 2.14 |
| Exemplified compound 2149 | A-304 | 49 | B-204 | 51 | 2.08 |
| Exemplified compound 2150 | A-304 | 80 | B-204 | 20 | 2.08 |
| Exemplified compound 2151 | A-304 | 35 | B-204 | 65 | 2.08 |
| Exemplified compound 2152 | A-304 | 20 | B-204 | 80 | 2.08 |
| Exemplified compound 2153 | A-304 | 49 | B-205 | 51 | 2.12 |
| Exemplified compound 2154 | A-304 | 80 | B-205 | 20 | 2.10 |
| Exemplified compound 2155 | A-304 | 35 | B-205 | 65 | 2.13 |
| Exemplified compound 2156 | A-304 | 20 | B-205 | 80 | 2.14 |
| Exemplified compound 2157 | A-304 | 49 | B-301 | 51 | 2.11 |
| Exemplified compound 2158 | A-304 | 80 | B-301 | 20 | 2.09 |
| Exemplified compound 2159 | A-304 | 35 | B-301 | 65 | 2.12 |

TABLE 3

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2160 | A-304 | 20 | B-301 | 80 | 2.12 |
| Exemplified compound 2161 | A-304 | 49 | B-302 | 51 | 2.11 |
| Exemplified compound 2162 | A-304 | 80 | B-302 | 20 | 2.09 |
| Exemplified compound 2163 | A-304 | 35 | B-302 | 65 | 2.11 |
| Exemplified compound 2164 | A-304 | 20 | B-302 | 80 | 2.12 |
| Exemplified compound 2165 | A-304 | 49 | B-303 | 51 | 2.12 |
| Exemplified compound 2166 | A-304 | 80 | B-303 | 20 | 2.10 |
| Exemplified compound 2167 | A-304 | 35 | B-303 | 65 | 2.13 |
| Exemplified compound 2168 | A-304 | 20 | B-303 | 80 | 2.14 |
| Exemplified compound 2169 | A-304 | 49 | B-304 | 51 | 2.11 |
| Exemplified compound 2170 | A-304 | 80 | B-304 | 20 | 2.09 |
| Exemplified compound 2171 | A-304 | 35 | B-304 | 65 | 2.12 |
| Exemplified compound 2172 | A-304 | 20 | B-304 | 80 | 2.13 |
| Exemplified compound 2173 | A-304 | 49 | B-305 | 51 | 2.06 |
| Exemplified compound 2174 | A-304 | 80 | B-305 | 20 | 2.07 |
| Exemplified compound 2175 | A-304 | 35 | B-305 | 65 | 2.05 |
| Exemplified compound 2176 | A-304 | 20 | B-305 | 80 | 2.04 |
| Exemplified compound 2177 | A-304 | 49 | B-306 | 51 | 2.12 |
| Exemplified compound 2178 | A-304 | 80 | B-306 | 20 | 2.10 |
| Exemplified compound 2179 | A-304 | 35 | B-306 | 65 | 2.14 |
| Exemplified compound 2180 | A-304 | 20 | B-306 | 80 | 2.15 |
| Exemplified compound 2181 | A-304 | 49 | B-307 | 51 | 2.11 |
| Exemplified compound 2182 | A-304 | 80 | B-307 | 20 | 2.09 |
| Exemplified compound 2183 | A-304 | 35 | B-307 | 65 | 2.11 |
| Exemplified compound 2184 | A-304 | 20 | B-307 | 80 | 2.12 |
| Exemplified compound 2185 | A-304 | 49 | B-308 | 51 | 2.12 |
| Exemplified compound 2186 | A-304 | 80 | B-308 | 20 | 2.10 |
| Exemplified compound 2187 | A-304 | 35 | B-308 | 65 | 2.13 |

TABLE 3-continued

| Specific examples of polycarbonate resins | | | | | |
|---|---|---|---|---|---|
| | Group A | | Group B | | |
| Exemplified compound No. | Structural unit | Proportion (mol %) | Structural unit | Proportion (mol %) | Dielectric constant |
| Exemplified compound 2188 | A-304 | 20 | B-308 | 80 | 2.14 |
| Exemplified compound 2189 | A-304 | 49 | B-401 | 51 | 2.15 |
| Exemplified compound 2190 | A-304 | 80 | B-401 | 20 | 2.11 |
| Exemplified compound 2191 | A-304 | 35 | B-401 | 65 | 2.17 |
| Exemplified compound 2192 | A-304 | 20 | B-401 | 80 | 2.19 |
| Exemplified compound 2193 | A-304 | 49 | B-402 | 51 | 2.19 |
| Exemplified compound 2194 | A-304 | 80 | B-402 | 20 | 2.13 |
| Exemplified compound 2195 | A-304 | 35 | B-402 | 65 | 2.22 |
| Exemplified compound 2196 | A-304 | 20 | B-402 | 80 | 2.26 |
| Exemplified compound 2197 | A-304 | 49 | B-403 | 51 | 2.25 |
| Exemplified compound 2198 | A-304 | 80 | B-403 | 20 | 2.15 |
| Exemplified compound 2199 | A-304 | 35 | B-403 | 65 | 2.29 |
| Exemplified compound 2200 | A-304 | 20 | B-403 | 80 | 2.34 |
| Exemplified compound 2201 | A-304 | 49 | B-404 | 51 | 2.13 |
| Exemplified compound 2202 | A-304 | 80 | B-404 | 20 | 2.10 |
| Exemplified compound 2203 | A-304 | 35 | B-404 | 65 | 2.14 |
| Exemplified compound 2204 | A-304 | 20 | B-404 | 80 | 2.15 |
| Exemplified compound 2205 | A-304 | 49 | B-405 | 51 | 2.19 |
| Exemplified compound 2206 | A-304 | 80 | B-405 | 20 | 2.12 |
| Exemplified compound 2207 | A-304 | 35 | B-405 | 65 | 2.22 |
| Exemplified compound 2208 | A-304 | 20 | B-405 | 80 | 2.25 |
| Exemplified compound 2209 | A-305 | 49 | B-201 | 51 | 2.12 |
| Exemplified compound 2210 | A-305 | 80 | B-201 | 20 | 2.07 |
| Exemplified compound 2211 | A-305 | 35 | B-201 | 65 | 2.14 |
| Exemplified compound 2212 | A-305 | 20 | B-201 | 80 | 2.17 |
| Exemplified compound 2213 | A-305 | 49 | B-202 | 51 | 2.06 |
| Exemplified compound 2214 | A-305 | 80 | B-202 | 20 | 2.05 |
| Exemplified compound 2215 | A-305 | 35 | B-202 | 65 | 2.07 |
| Exemplified compound 2216 | A-305 | 20 | B-202 | 80 | 2.08 |
| Exemplified compound 2217 | A-305 | 49 | B-203 | 51 | 2.09 |
| Exemplified compound 2218 | A-305 | 80 | B-203 | 20 | 2.06 |
| Exemplified compound 2219 | A-305 | 35 | B-203 | 65 | 2.11 |
| Exemplified compound 2220 | A-305 | 20 | B-203 | 80 | 2.13 |
| Exemplified compound 2221 | A-305 | 49 | B-204 | 51 | 2.05 |
| Exemplified compound 2222 | A-305 | 80 | B-204 | 20 | 2.04 |
| Exemplified compound 2223 | A-305 | 35 | B-204 | 65 | 2.06 |
| Exemplified compound 2224 | A-305 | 20 | B-204 | 80 | 2.07 |
| Exemplified compound 2225 | A-305 | 49 | B-205 | 51 | 2.09 |
| Exemplified compound 2226 | A-305 | 80 | B-205 | 20 | 2.06 |
| Exemplified compound 2227 | A-305 | 35 | B-205 | 65 | 2.11 |
| Exemplified compound 2228 | A-305 | 20 | B-205 | 80 | 2.13 |
| Exemplified compound 2229 | A-305 | 49 | B-301 | 51 | 2.08 |
| Exemplified compound 2230 | A-305 | 80 | B-301 | 20 | 2.05 |
| Exemplified compound 2231 | A-305 | 35 | B-301 | 65 | 2.10 |
| Exemplified compound 2232 | A-305 | 20 | B-301 | 80 | 2.11 |
| Exemplified compound 2233 | A-305 | 49 | B-302 | 51 | 2.08 |
| Exemplified compound 2234 | A-305 | 80 | B-302 | 20 | 2.05 |
| Exemplified compound 2235 | A-305 | 35 | B-302 | 65 | 2.10 |
| Exemplified compound 2236 | A-305 | 20 | B-302 | 80 | 2.11 |
| Exemplified compound 2237 | A-305 | 49 | B-303 | 51 | 2.09 |
| Exemplified compound 2238 | A-305 | 80 | B-303 | 20 | 2.06 |
| Exemplified compound 2239 | A-305 | 35 | B-303 | 65 | 2.11 |
| Exemplified compound 2240 | A-305 | 20 | B-303 | 80 | 2.13 |
| Exemplified compound 2241 | A-305 | 49 | B-304 | 51 | 2.09 |
| Exemplified compound 2242 | A-305 | 80 | B-304 | 20 | 2.06 |
| Exemplified compound 2243 | A-305 | 35 | B-304 | 65 | 2.10 |
| Exemplified compound 2244 | A-305 | 20 | B-304 | 80 | 2.12 |
| Exemplified compound 2245 | A-305 | 49 | B-305 | 51 | 2.03 |
| Exemplified compound 2246 | A-305 | 80 | B-305 | 20 | 2.03 |
| Exemplified compound 2247 | A-305 | 35 | B-305 | 65 | 2.03 |
| Exemplified compound 2248 | A-305 | 20 | B-305 | 80 | 2.03 |
| Exemplified compound 2249 | A-305 | 49 | B-306 | 51 | 2.10 |
| Exemplified compound 2250 | A-305 | 80 | B-306 | 20 | 2.06 |
| Exemplified compound 2251 | A-305 | 35 | B-306 | 65 | 2.12 |
| Exemplified compound 2252 | A-305 | 20 | B-306 | 80 | 2.14 |
| Exemplified compound 2253 | A-305 | 49 | B-307 | 51 | 2.08 |
| Exemplified compound 2254 | A-305 | 80 | B-307 | 20 | 2.05 |
| Exemplified compound 2255 | A-305 | 35 | B-307 | 65 | 2.10 |
| Exemplified compound 2256 | A-305 | 20 | B-307 | 80 | 2.11 |
| Exemplified compound 2257 | A-305 | 49 | B-308 | 51 | 2.09 |
| Exemplified compound 2258 | A-305 | 80 | B-308 | 20 | 2.06 |
| Exemplified compound 2259 | A-305 | 35 | B-308 | 65 | 2.11 |
| Exemplified compound 2260 | A-305 | 20 | B-308 | 80 | 2.13 |

TABLE 3-continued

Specific examples of polycarbonate resins

| Exemplified compound No. | Group A Structural unit | Group A Proportion (mol %) | Group B Structural unit | Group B Proportion (mol %) | Dielectric constant |
|---|---|---|---|---|---|
| Exemplified compound 2261 | A-305 | 49 | B-401 | 51 | 2.13 |
| Exemplified compound 2262 | A-305 | 80 | B-401 | 20 | 2.07 |
| Exemplified compound 2263 | A-305 | 35 | B-401 | 65 | 2.16 |
| Exemplified compound 2264 | A-305 | 20 | B-401 | 80 | 2.18 |
| Exemplified compound 2265 | A-305 | 49 | B-402 | 51 | 2.17 |
| Exemplified compound 2266 | A-305 | 80 | B-402 | 20 | 2.09 |
| Exemplified compound 2267 | A-305 | 35 | B-402 | 65 | 2.21 |
| Exemplified compound 2268 | A-305 | 20 | B-402 | 80 | 2.25 |
| Exemplified compound 2269 | A-305 | 49 | B-403 | 51 | 2.22 |
| Exemplified compound 2270 | A-305 | 80 | B-403 | 20 | 2.11 |
| Exemplified compound 2271 | A-305 | 35 | B-403 | 65 | 2.28 |
| Exemplified compound 2272 | A-305 | 20 | B-403 | 80 | 2.33 |
| Exemplified compound 2273 | A-305 | 49 | B-404 | 51 | 2.10 |
| Exemplified compound 2274 | A-305 | 80 | B-404 | 20 | 2.06 |
| Exemplified compound 2275 | A-305 | 35 | B-404 | 65 | 2.12 |
| Exemplified compound 2276 | A-305 | 20 | B-404 | 80 | 2.14 |
| Exemplified compound 2277 | A-305 | 49 | B-405 | 51 | 2.16 |
| Exemplified compound 2278 | A-305 | 80 | B-405 | 20 | 2.09 |
| Exemplified compound 2279 | A-305 | 35 | B-405 | 65 | 2.20 |
| Exemplified compound 2280 | A-305 | 20 | B-405 | 80 | 2.24 |

Synthesis of the Polycarbonate Resin

The following describes a method for synthesizing exemplified compound 1921 by way of example. The other polycarbonate resins can be synthesized using appropriate group-A and group-B structural raw materials (raw materials from which the structural units selected from group A and group B, respectively, are produced) in appropriate amounts in the method described in Synthesis of exemplified compound 1921 below. The weight-average molecular weight of the resin can be adjusted by controlling the amount of the molecular-weight modifier.

Synthesis of Exemplified Compound 1921

The following materials were dissolved in 1100 ml of a 5% by mass aqueous solution of sodium hydroxide: 47.5 g (0.196 mol) of 1,1-bis(4-hydroxyphenyl)-2-methyl propane (Wako Pure Chemical Industries, product code 131-11331) as group-A structural raw material, 38.0 g (0.204 mol) of 4,4'-dihydroxybiphenyl (Tokyo Chemical Industry, product code B0464) as group-B structural raw material, and 0.1 g of hydrosulfite. After the addition of 500 ml of methylene chloride, 60 g of phosgene was blown into the solution over 60 minutes with stirring, with the temperature maintained at 15° C.

The reaction solution into which the phosgene had been blown was stirred with 1.3 g of p-t-butylphenol (Tokyo Chemical Industry, product code B0383) as a molecular-weight modifier until emulsification. The resulting emulsion was stirred at 23° C. for 1 hour with 0.4 ml of triethylamine for polymerization.

After the completion of polymerization, the reaction solution was separated into aqueous and organic phases. The organic phase was neutralized with phosphoric acid and then repeatedly washed with water until the conductivity of the washing (aqueous phase) was 10 μS/cm or less. The resulting solution of polymer was added dropwise into warm water kept at 45° C., and the solvent was evaporated away. This yielded a white powdery precipitate. This precipitate was collected through filtration and dried at 110° C. for 24 hours. In this way, the exemplified compound 1921 polycarbonate resin was obtained as a copolymer composed of group-A structural unit A-301 and group-B structural unit B-201.

The obtained polycarbonate resin was analyzed using infrared absorption spectroscopy. The spectrum had a carbonyl absorption at around 1770 $cm^{-1}$ and an ether absorption at around 1240 $cm^{-1}$, identifying the product to be a polycarbonate resin.

Electrophotographic Photosensitive Member

An electrophotographic photosensitive member according to an aspect of the invention has a support, a charge generation layer, and a charge transport layer as a surface layer in this order. There may be other layers between the support and the charge transport layer. The details of the individual layers are given below.

This electrophotographic photosensitive member can be manufactured through, for example, preparation of coating liquids for forming the layers described below and subsequent application and drying of these liquids in the desired order of layers. Examples of methods that can be used to apply the coating liquids include dip coating, spray coating, curtain coating, and spin coating. In particular, dip coating provides excellent efficiency and productivity.

Support

In an embodiment of the invention, the support can be a conductive support, i.e., a support having electroconductivity. Examples of conductive supports include supports made of aluminum, iron, nickel, copper, gold, or other metals or alloys and supports composed of an insulating substrate, such as polyester resin, polycarbonate resin, polyimide resin, or glass, and any of the following thin films thereon: a thin film of aluminum, chromium, silver, gold, or similar metals; a thin film of indium oxide, tin oxide, zinc oxide, or similar conductive materials; and a thin film of a conductive ink containing silver nanowires.

The surface of the support may have been treated for the purpose of improved electrical characteristics and reduced interference fringes. Examples of treatments include anodization and other electrochemical processes, wet honing, blasting, and cutting.

With regard to shape, the support can be, for example, a cylinder or a film.

Conductive Layer

In an embodiment of the invention, there may be a conductive layer on the support. Such a conductive layer prevents interference fringes by covering irregularities and defects on the support. The average thickness of the conductive layer can be 5 μm or more and 40 μm or less, preferably 10 μm or more and 30 μm or less.

The conductive layer may contain conductive particles and a binder resin. The conductive particles can be carbon black, metallic particles, metal oxide particles, or similar.

The metal oxide particles can be particles of zinc oxide, white lead, aluminum oxide, indium oxide, silicon oxide, zirconium oxide, tin oxide, titanium oxide, magnesium oxide, antimony oxide, bismuth oxide, tin-doped indium oxide, antinomy- or tantalum-doped tin oxide, or similar. A combination of two or more of these particles can also be used. Particles of zinc oxide, tin oxide, and titanium oxide are preferred. In particular, titanium oxide particles, absorbing little of visible and near-infrared light and white in color, provide high sensitivity. Titanium oxide has several crystal forms, such as rutile, anatase, brookite, and amorphous, and any of these crystal forms can be used, preferably rutile. It is also possible to use needle or granular crystals of titanium oxide. The number-average primary particle diameter of the metal oxide particles can be in the range of 0.05 to 1 μm, preferably 0.1 to 0.5 μm.

The binder resin can be phenolic, polyurethane, polyamide, polyimide, polyamide-imide, polyvinyl acetal, epoxy, acrylic, melamine, polyester, or similar resins. A combination of two or more of these resins can also be used. In particular, curable resins render the conductive layer highly resistant to solvents that can be used in the coating liquids for the formation of other layers and highly adhesive to a conductive support, without compromising the dispersibility and dispersion stability of metal oxide particles. Such a curable resin can be a thermosetting resin. Examples of thermosetting resins include thermosetting phenolic resins and thermosetting polyurethane resins.

Undercoat Layer

In an embodiment of the invention, there may be an undercoat layer on the support or the conductive layer. Such an undercoat layer provides enhanced barrier properties and adhesiveness. The average thickness of the undercoat layer can be 0.3 μm or more and 5.0 μm or less.

The undercoat layer may contain a binder resin and either an electron transport material or metal oxide particles. Such a structure provides a pathway through which electrons generated in a charge generation layer, one of the two kinds of electric charge generated in the charge generation layer, can be transported to the support. This prevents any increase in the occurrence of charge deactivation and trapping in the charge generation layer associated with improving capacity of the charge transport layer to transport charge. As a result, the initial electrical characteristics and the electrical characteristics after repeated use are improved.

Examples of electron transport materials include quinone, imide, benzimidazole, cyclopentadienylidene, fluorenone, xanthone, benzophenone, cyanovinyl, naphthylimide, and peryleneimide compounds. The electron transport material may have a polymerizable functional group, such as a hydroxy, thiol, amino, carboxy, or methoxy group.

For the metal oxide particles and the binder resin, the details are the same as in the foregoing "Conductive layer" section.

Charge Generation Layer

In an embodiment of the invention, there is a charge generation layer between the support and the charge transport layer. The charge generation layer may be contiguous to the charge transport layer. The thickness of the charge generation layer can be 0.05 μm or more and 1 μm or less, preferably 0.1 μm or more and 0.3 μm or less.

In an embodiment of the invention, the charge generation layer may contain a charge generation material and a binder resin.

The charge generation material content of the charge generation layer can be 40% by mass or more and 85% by mass or less, preferably 60% by mass or more and 80% by mass or less.

Examples of charge generation materials include: monoazo, disazo, and trisazo pigments, and other azo pigments; phthalocyanine pigments including metal phthalocyanine complexes and metal-free phthalocyanine; indigo pigments; perylene pigments; polycyclic quinone pigments; squarylium dyes; thiapyrylium salts; quinacridone pigments; azulenium salt pigments; cyanine dyes; xanthene dyes; quinone imine dyes; and styryl dyes. It is preferred that the charge generation material be a phthalocyanine pigment, more preferably crystalline gallium phthalocyanine.

Crystalline hydroxygallium phthalocyanine, crystalline chlorogallium phthalocyanine, crystalline bromogallium phthalocyanine, and crystalline iodogallium phthalocyanine have excellent sensitivity compared to other crystalline gallium phthalocyanines. Crystalline hydroxygallium phthalocyanine and crystalline chlorogallium phthalocyanine are particularly preferred. In crystalline hydroxygallium phthalocyanine, the gallium atom is coordinated by hydroxy groups as axial ligands. In crystalline chlorogallium phthalocyanine, the gallium atom is coordinated by chlorine atoms as axial ligands. In crystalline bromogallium phthalocyanine, the gallium atom is coordinated by bromine atoms as axial ligands. In crystalline iodogallium phthalocyanine, the gallium atom is coordinated by iodine atoms as axial ligands. Particularly high sensitivity is obtained with the use of a crystalline hydroxygallium phthalocyanine that exhibits peaks at Bragg angles 2θ of 7.4°±0.3° and 28.3°±0.3° in its CuKα X-ray diffraction pattern or a crystalline chlorogallium phthalocyanine that exhibits peaks at Bragg angles 2θ±0.2° of 7.4°, 16.6°, 25.5°, and 28.3° in its CuKα X-ray diffraction pattern.

The crystalline gallium phthalocyanine may contain an amide compound represented by the formula below in its crystal structure.

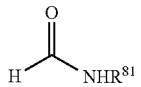

(In this formula, $R^{81}$ represents a methyl, propyl, or vinyl group.)

Specific examples of such amide compounds include N-methylformamide, N-propylformamide, and N-vinylformamide.

The amide compound content can be 0.1% by mass or more and 1.9% by mass or less, preferably 0.3% by mass or more and 1.5% by mass or less, with respect to the gallium phthalocyanine complex in the crystalline gallium phthalocyanine. When the amide compound content is 0.1% by mass or more and 1.9% by mass or less, the dark current from the charge generation layer at increased electric field intensity is small in the opinion of the inventors, making the charge transport layer according to this embodiment of the invention more effective in reducing fog. The amide compound content can be measured using $^{1}$H-NMR spectroscopy.

The crystalline gallium phthalocyanine containing an amide compound in its crystal structure can be obtained through a transformation process in which acid-pasted or dry-milled gallium phthalocyanine is wet-milled in a solvent containing the amide compound.

This process of wet milling is performed using a milling apparatus, such as a sand mill or a ball mill, with a dispersant, such as glass beads, steel beads, or alumina balls.

As for the binder resin, examples include resins such as polyester, acrylic resin, polycarbonate, polyvinyl butyral, polystyrene, polyvinyl acetate, polysulfone, acrylonitrile copolymers, and polyvinyl benzal. In particular, polyvinyl butyral and polyvinyl benzal are effective in dispersing crystalline gallium phthalocyanine.

Charge Transport Layer

In an embodiment of the invention, the charge transport layer contains a charge transport material and a polycarbonate resin that has a structural unit selected from group A and a structural unit selected from group B. The charge transport layer may optionally contain additives, such as a release agent for more efficient transfer of toner, an anti-fingerprint agent to reduce soiling or similar, filler to reduce scraping, and lubricant for higher lubricity.

In an embodiment of the invention, the charge transport layer can be formed by preparing a coating liquid for the formation of the charge transport layer by mixing the charge transport material and the polycarbonate resin with a solvent, applying this coating liquid for the formation of the charge transport layer to form a wet coating, and drying this wet coating.

The solvent used in the coating liquid for the formation of the charge transport layer can be, for example, a ketone-based solvent, such as acetone or methyl ethyl ketone; an ester-based solvent, such as methyl acetate or ethyl acetate; an aromatic hydrocarbon solvent, such as toluene, xylene, or chlorobenzene; an ether-based solvent, such as 1,4-dioxane or tetrahydrofuran; or a halogenated hydrocarbon solvent, such as chloroform. A combination of two or more of these solvents can also be used. Solvents having a dipole moment of 1.0 D or less are preferred. Examples of solvents having a dipole moment of 1.0 D or less include o-xylene (dipole moment=0.64 D) and methylal (dipole moment=0.91 D).

The thickness of the charge transport layer can be 5 μm or more and 40 μm or less, preferably 7 μm or more and 25 μm or less.

The charge transport material content of the charge transport layer can be 20% by mass or more and 80% by mass or less, preferably 40% by mass or more and 70% by mass or less for more effective reduction of fog and higher long-term storage stability of the electrophotographic photosensitive member.

The molecular weight of the charge transport material can be 300 or more and 1,000 or less. For better electrical characteristics after repeated use and higher long-term storage stability, it is preferred that the molecular weight of the charge transport material be 600 or more and 800 or less. For more effective prevention of photomemories and higher long-term storage stability, it is preferred that the molecular weight of the charge transport material be 350 or more and 600 or less.

The charge transport material can be, for example, a triarylamine, hydrazone, stilbene, pyrazoline, oxazole, thiazole, or triallylamine compound, preferably a triarylamine compound. A combination of two or more of these compounds can also be used. The following are some specific examples of charge transport materials, represented by general formulae and exemplified compounds for each general formula.

(CTM-1)

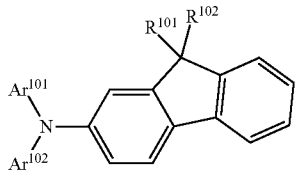

(In this formula, $Ar^{101}$ and $Ar^{102}$ each independently represent a substituted or unsubstituted aryl group. $R^{101}$ and $R^{102}$ each independently represent a hydrogen atom, an alkyl group, or a substituted or unsubstituted aryl group. Possible substituents for an aryl group are alkyl and alkoxy groups and a halogen atom.)

Here are some exemplified compounds for (CTM-1).

(101)

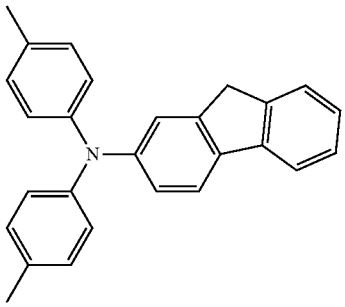

(102)

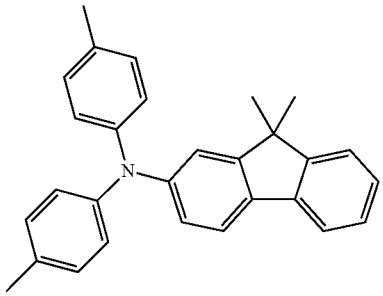

(103)

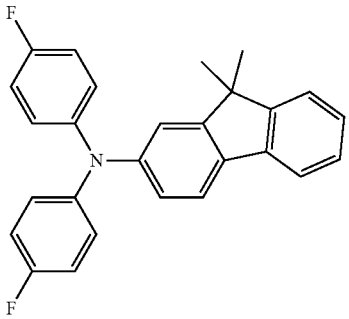

(104)

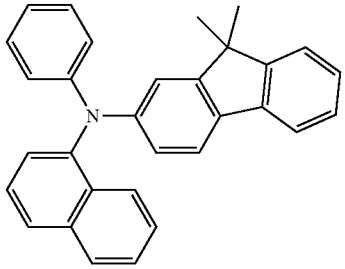

(105)

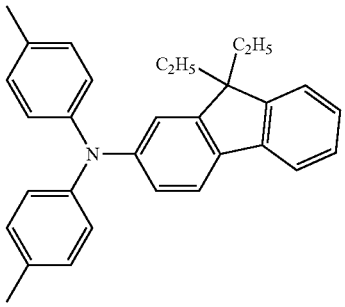

-continued (106)

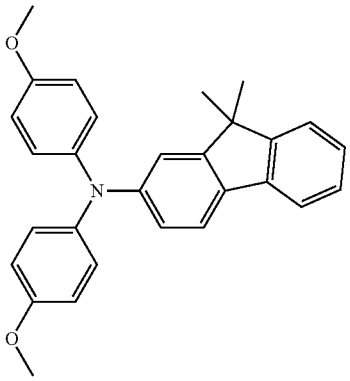

(107)

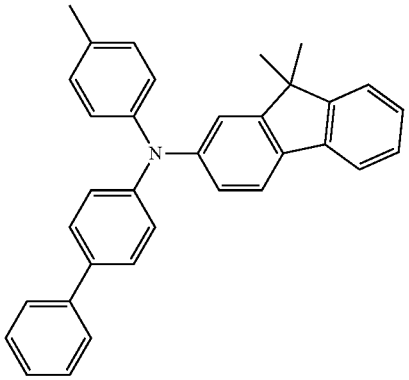

-continued (108)

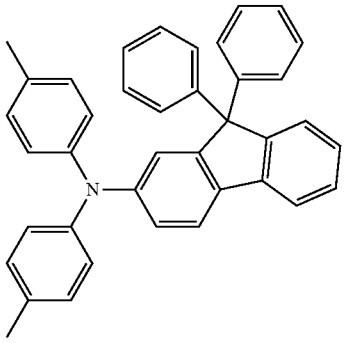

(CTM-2)

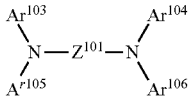

(In this formula, $Ar^{103}$ to $Ar^{106}$ each independently represent a substituted or unsubstituted aryl group. $Z^{101}$ represents a substituted or unsubstituted arylene group or a divalent group in which multiple arylene groups are linked via a vinylene group. There may be a ring formed by two adjacent substituents on $Ar^{103}$ to $Ar^{106}$. Possible substituents for an aryl or arylene group are alkyl and alkoxy groups and a halogen atom.)

Here are some exemplified compounds for (CTM-2).

(201)

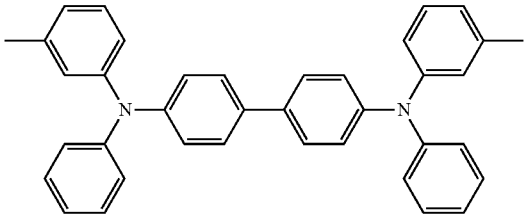

(202)

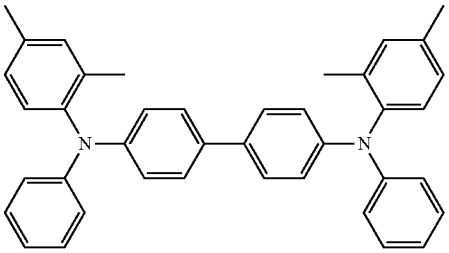

(203)

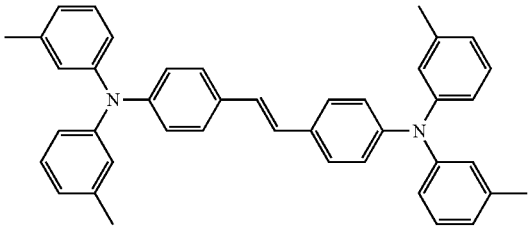

(204)

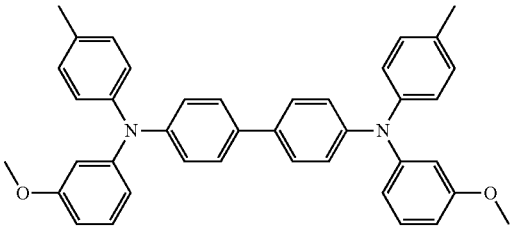

-continued
(205)
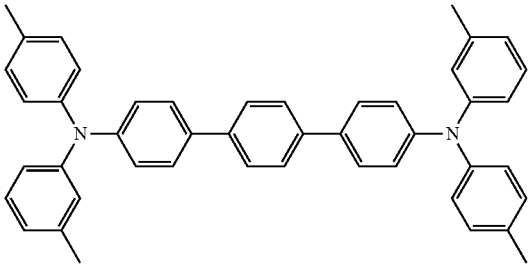
(206)
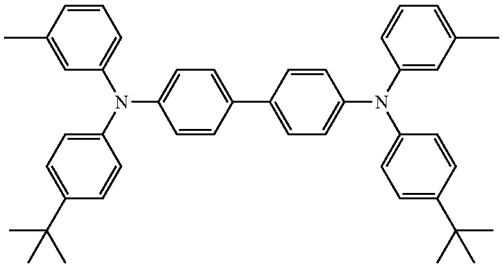
(207)
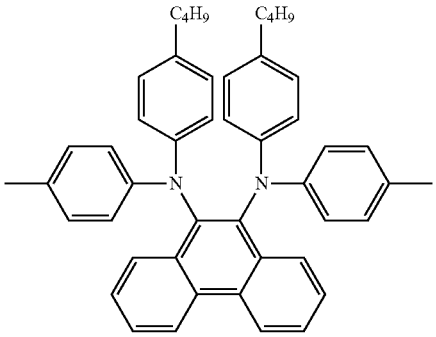
(208)
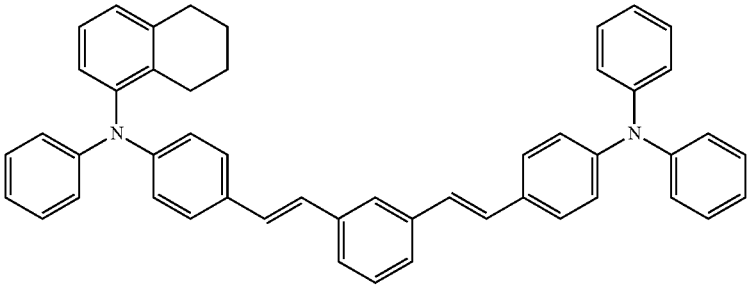
(209)
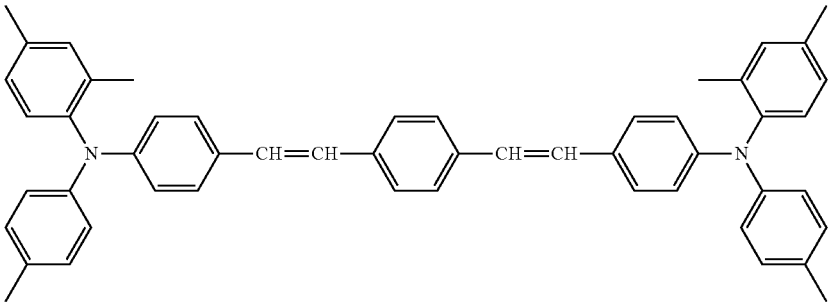
(210)
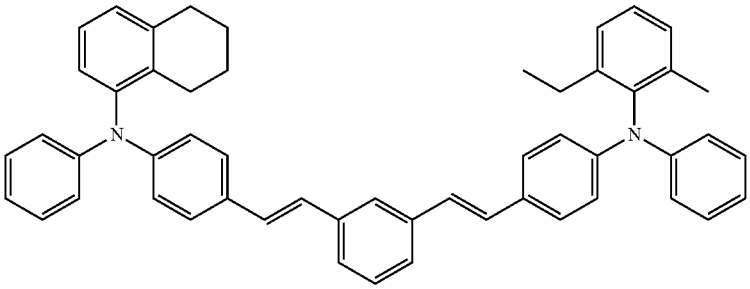

-continued (211)

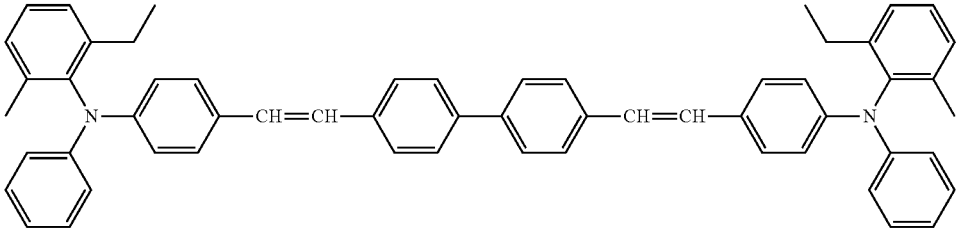

(212)

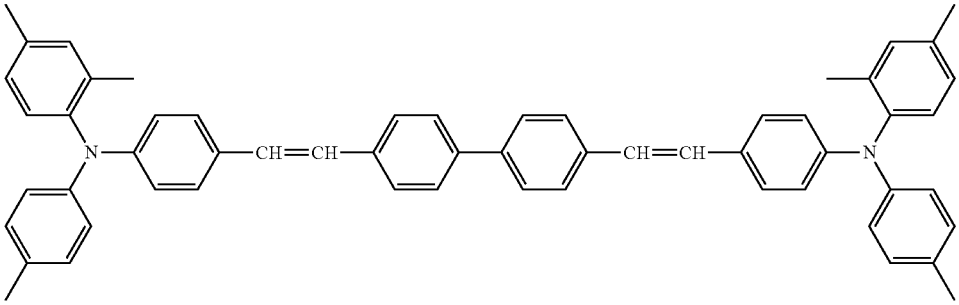

(CTM-3)

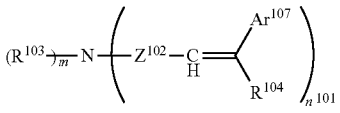

(In this formula, $R^{103}$ represents an alkyl group, a cycloalkyl group, or a substituted or unsubstituted aryl group. $R^{104}$ represents a hydrogen atom, an alkyl group, or a substituted or unsubstituted aryl group. $Ar^{107}$ represents a substituted or unsubstituted aryl group. $Z^{102}$ represents a substituted or unsubstituted arylene group. $n^{101}$ and m are integers of 1 to 3 and 0 to 2, respectively, with $m+n^{101}=3$. When m is 2, the two $R^{103}$ groups may be groups of the same kind or different groups, and there may be a ring formed by two adjacent substituents on the two $R^{103}$ groups. There may be a ring formed by $R^{103}$ and $Z^{102}$. Furthermore, there may be a ring formed by $Ar^{107}$ and $R^{104}$ involving a linking vinylene group. Possible substituents for an aryl or arylene group are alkyl and alkoxy groups and a halogen atom.)

Here are some exemplified compounds for (CTM-3).

(301)

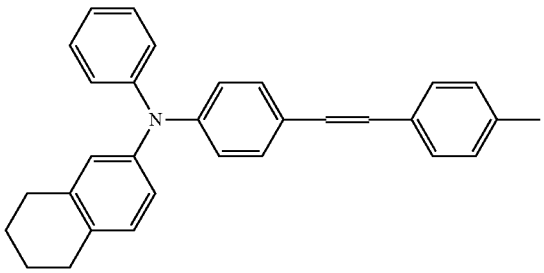

-continued (302)

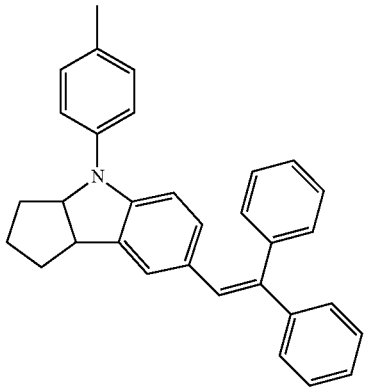

(303)

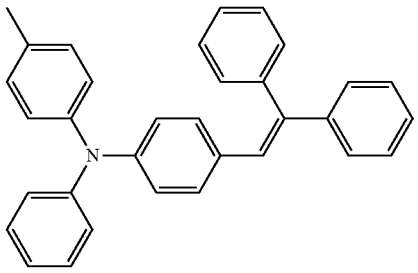

-continued
(304)
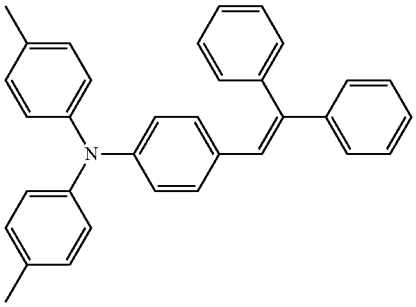
(305)
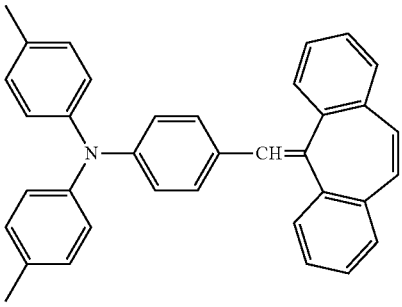
(306)
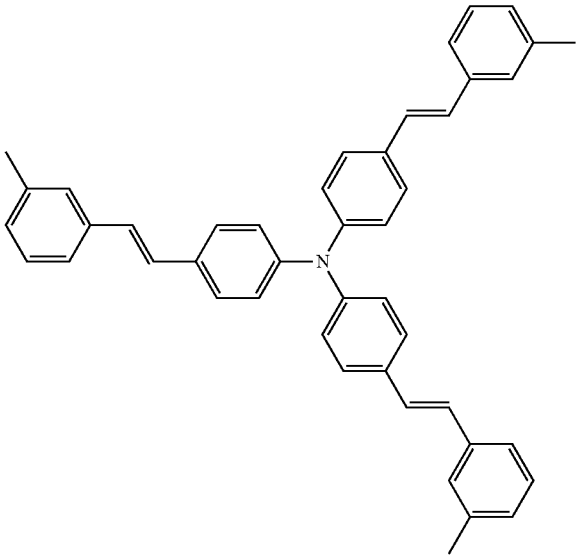
(307)
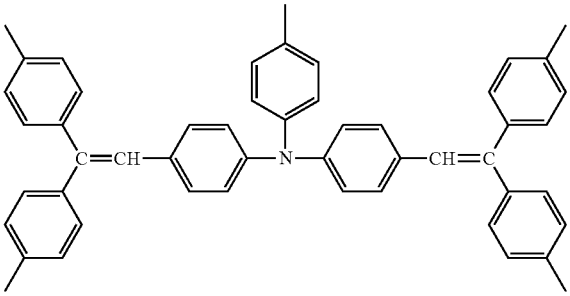
-continued
(308)
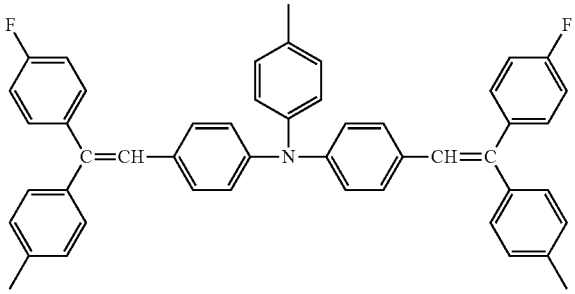
(309)
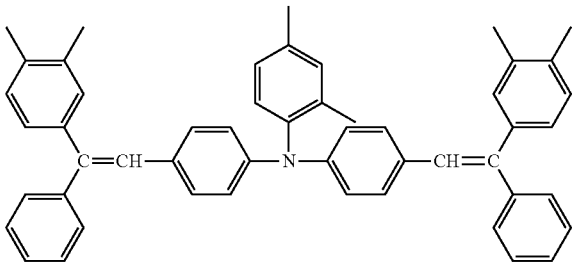
(CTM-4)
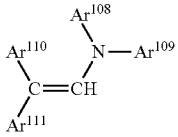
(In this formula, $Ar^{108}$ to $Ar^{111}$ each independently represent a substituted or unsubstituted aryl group. Possible substituents for an aryl group are an alkyl group, an alkoxy group, a halogen atom, and a 4-phenyl-buta-1,3-dienyl group.)
Here are some exemplified compounds for (CTM-4).
(401)
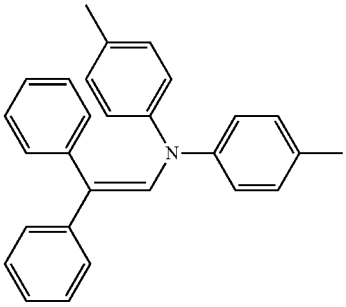
(402)
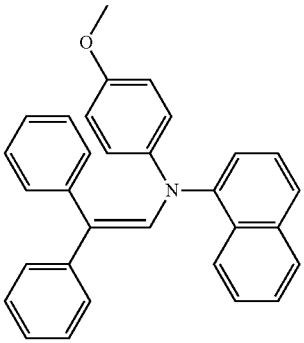

-continued (403)

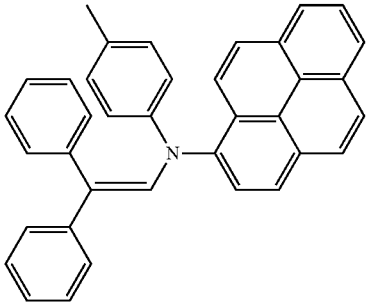

(404)

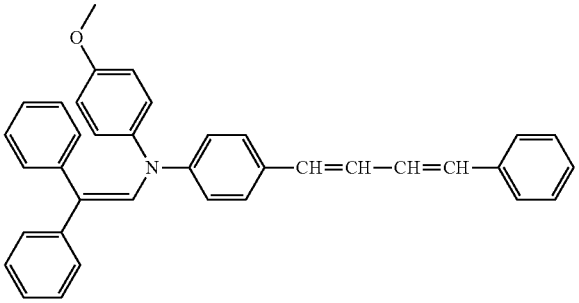

(405)

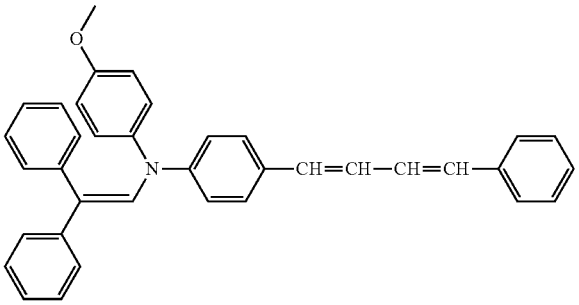

(CTM-5)

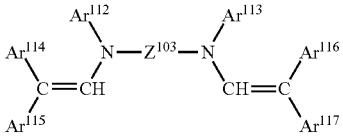

(In this formula, $Ar^{112}$ to $Ar^{117}$ each independently represent a substituted or unsubstituted aryl group. $Z^{103}$ represents a phenylene group, a biphenylene group, or a divalent group in which two phenylene groups are linked via an alkylene group. Possible substituents for an aryl group are alkyl and alkoxy groups and a halogen atom.)

Here are some exemplified compounds for (CTM-5).

(501)

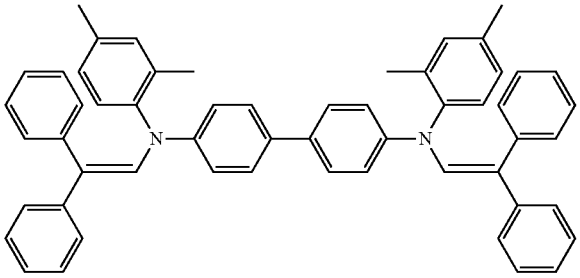

-continued (502)

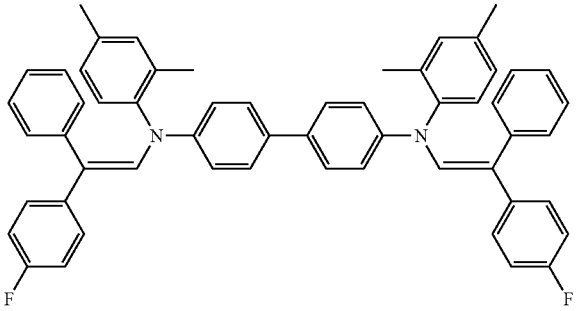

(503)

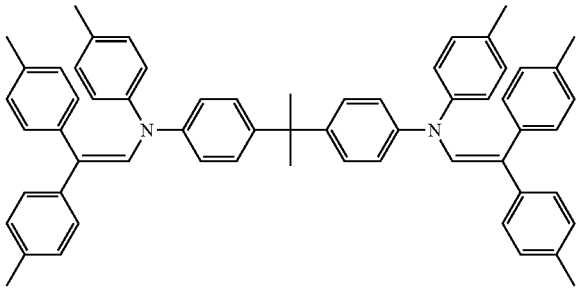

(504)

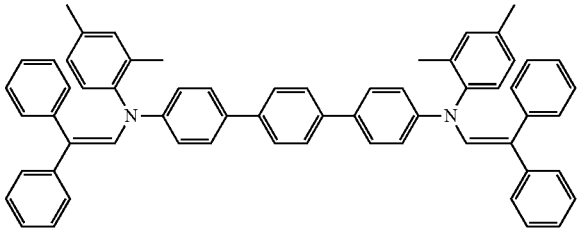

(505)

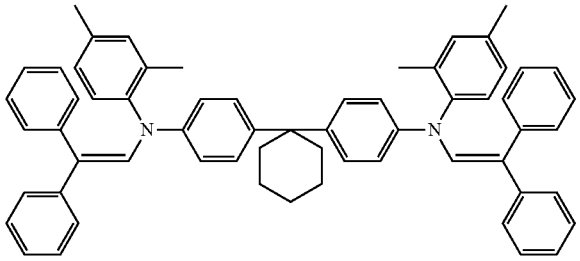

(506)

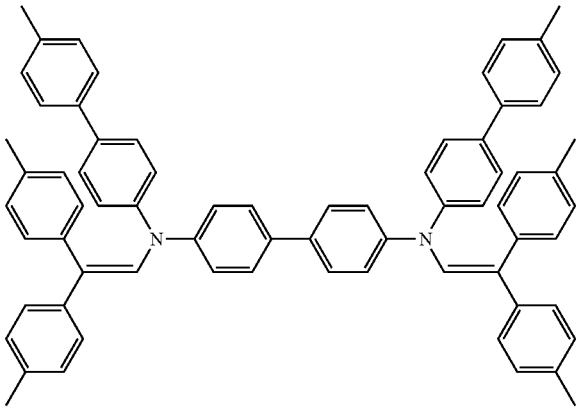

-continued (CTM-6)

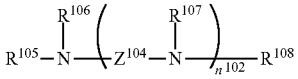

(In this formula, $R^{105}$ to $R^{108}$ each independently represent a monovalent group according to the formula below or an alkyl group or a substituted or unsubstituted aryl group, with at least one being a monovalent group according to the formula below. $Z^{104}$ represents a substitute or unsubstituted arylene group or a divalent group in which multiple arylene groups are linked via a vinylene group. $n^{102}$ is 0 or 1. Possible substituents for an aryl or arylene group are alkyl and alkoxy groups and a halogen atom.)

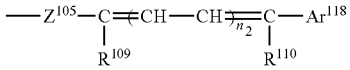

(In this formula, $R^{109}$ and $R^{110}$ each independently represent a hydrogen atom, an alkyl group, or a substituted or unsubstituted aryl group. $Ar^{118}$ represents a substituted or unsubstituted aryl group. $Z^{105}$ represents a substituted or unsubstituted arylene group. $n_2$ is an integer of 1 to 3. Possible substituents for an aryl group are alkyl, alkoxy, dialkylamino, and diarylamino groups. Possible substituents for the arylene group are alkyl and alkoxy groups and a halogen atom.)

Here are some exemplified compounds for (CTM-6).

(601)

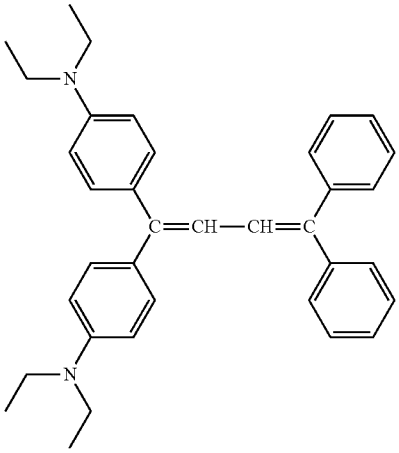

(602)

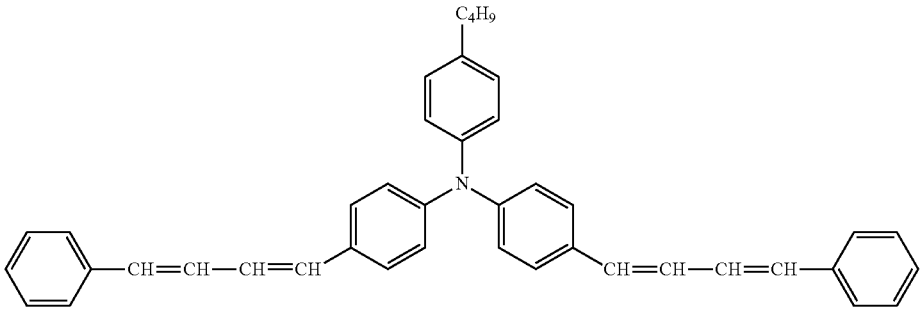

(603)

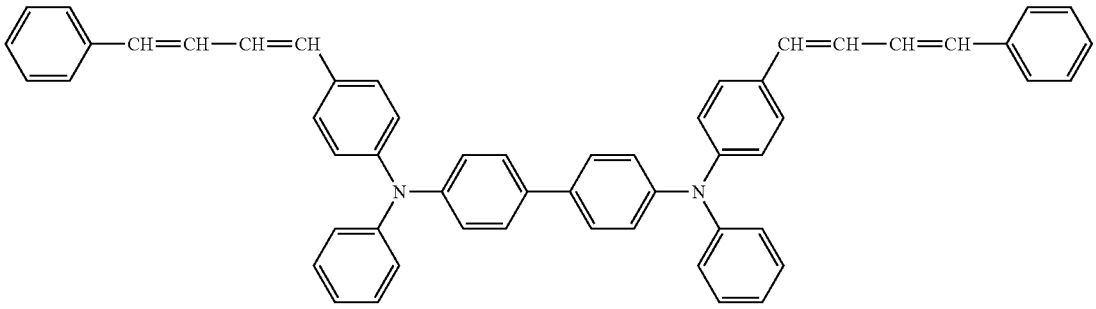

-continued
(604)
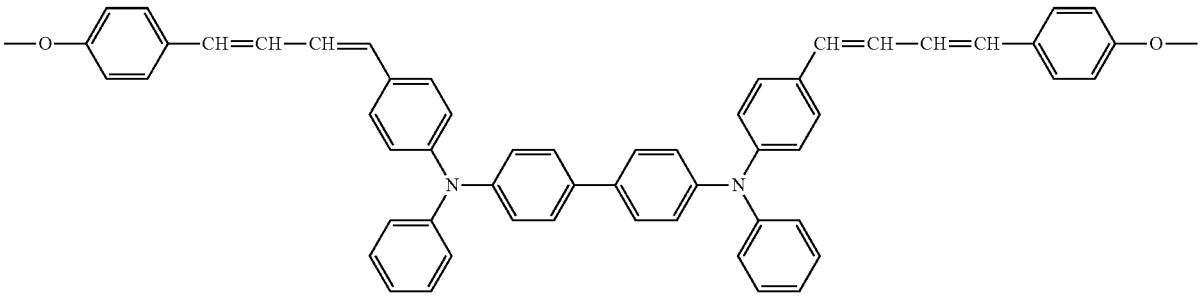
(605)
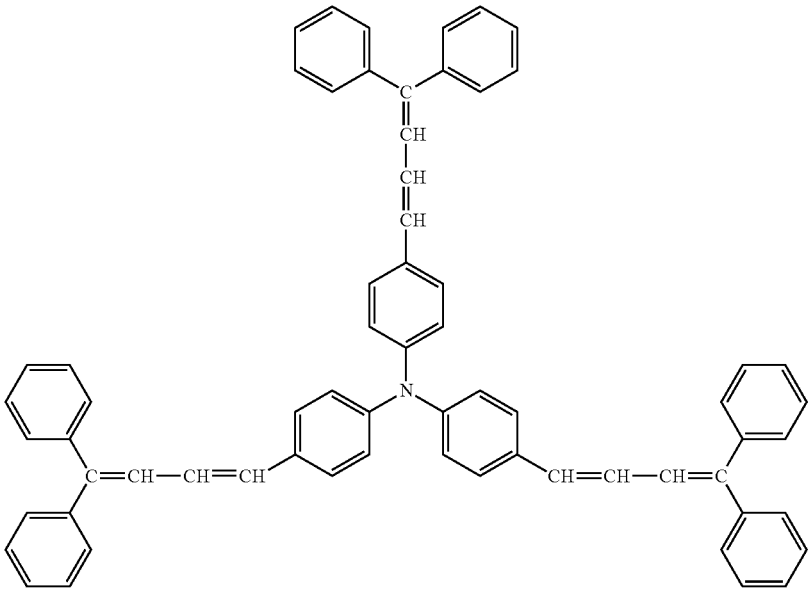
(606)
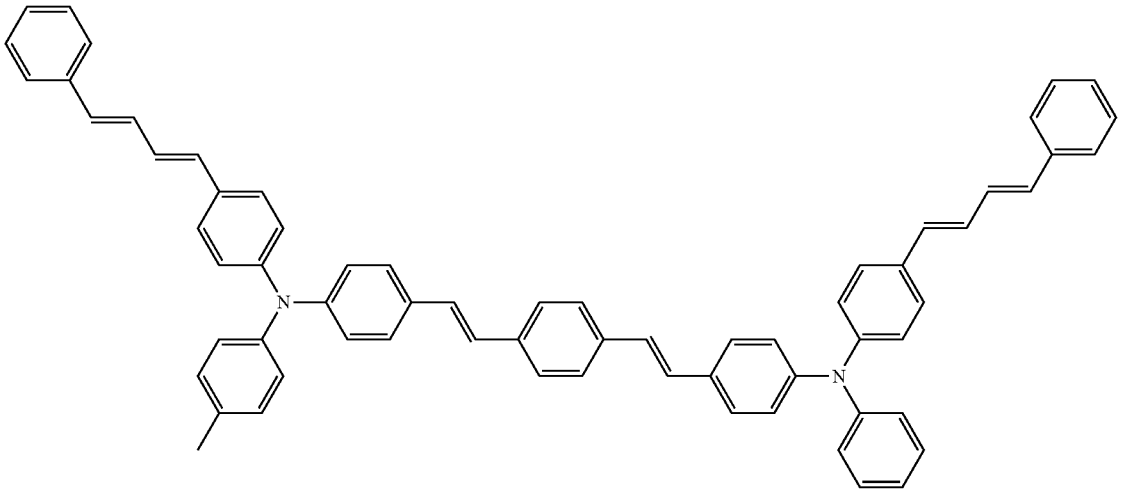
(CTM-7)
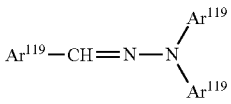

(In this formula, $Ar^{119}$ represents a substituted or unsubstituted aryl group or a monovalent group according to formula (7-1) or (7-2). $Ar^{120}$ and $Ar^{121}$ each independently represent a substituted or unsubstituted aryl group. Possible substituents for an aryl group are alkyl and alkoxy groups and a halogen atom.)

(7-1)

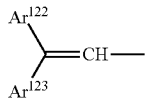

(In this formula, $Ar^{121}$ and $Ar^{123}$ each independently represent a substituted or unsubstituted aryl group or a substituted or unsubstituted aralkyl group. Possible substituents for an aryl and aralkyl group are alkyl and alkoxy groups and a halogen atom.)

(7-2)

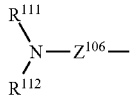

(In this formula, $R^{111}$ and $R^{112}$ each independently represent a substituted or unsubstituted aryl group. $Z^{106}$ represents a substituted or unsubstituted arylene group. Possible substituents for an aryl and arylene group are alkyl and alkoxy groups and a halogen atom.

Here are some exemplified compounds for (CTM-7).

(701)

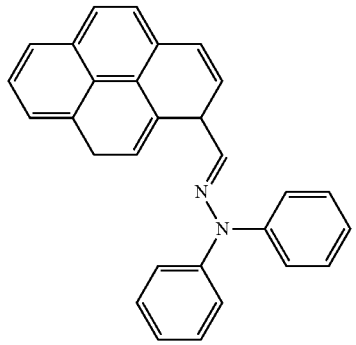

(702)

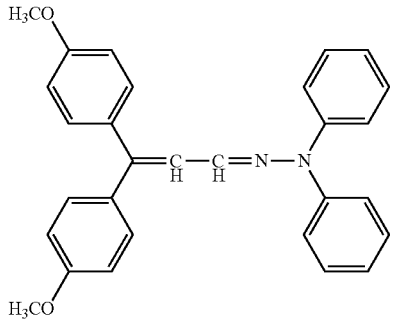

(703)

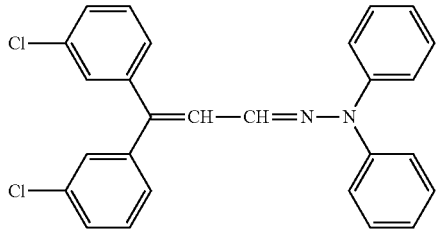

-continued (704)

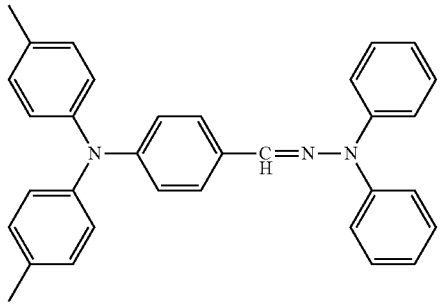

(705)

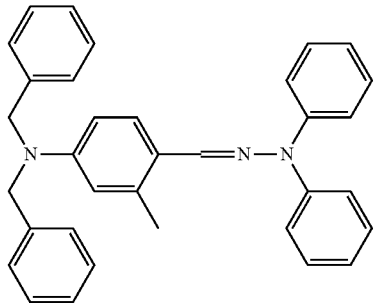

(706)

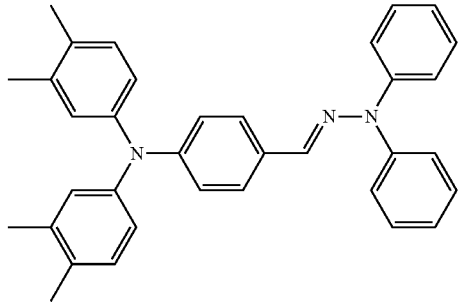

Process Cartridge and Electrophotographic Apparatus

FIG. 1 illustrates an example of a schematic structure of an electrophotographic apparatus installed with a process cartridge that incorporates an electrophotographic photosensitive member according to an aspect of the invention.

A cylindrical (drum-shaped) electrophotographic photosensitive member 1 is driven to rotate around a shaft 2 in the direction of the arrow at a predetermined circumferential velocity (process speed). During rotation, the surface of the electrophotographic photosensitive member 1 is charged to a predetermined positive or negative potential by a charging unit 3. The charged surface of the electrophotographic photosensitive member 1 is then irradiated with exposure light 4 emitted from an exposure unit (not illustrated). This produces an electrostatic latent image corresponding to the intended image information. The exposure light 4 is, for example, light emitted from an image exposure unit, such as a slit exposure or laser scanning exposure unit, and intensity-modulated according to the time-sequence electric digital pixel signal of the intended image information.

The electrostatic latent image formed on the surface of the electrophotographic photosensitive member 1 is then developed (normal development or reversal development) using toner contained in a development unit 5. This produces a toner image on the surface of the electrophotographic photosensitive member 1. The toner image formed on the surface of the electrophotographic photosensitive member 1 is transferred to a transfer medium 7 by a transfer unit 6. To the transfer unit 6, a bias power supply (not illustrated) applies a bias voltage having the opposite polarity with respect to the charge the toner has. When the transfer medium 7 is paper, the transfer medium 7 is discharged from a feeding section (not illustrated) in synchronization with the rotation of the electrophotographic photosensitive member 1 and fed into the space between the electrophotographic photosensitive member 1 and the transfer unit 6.

The transfer medium 7 carrying the toner image transferred from the electrophotographic photosensitive member 1 is separated from the surface of the electrophotographic photosensitive member 1 and conveyed to a fixing unit 8, at which the toner image is fixed. As a result, an image-bearing article (a photographic print or copy) is printed out of the electrophotographic apparatus.

The surface of the electrophotographic photosensitive member 1 following transferring the toner image to the transfer medium 7 is cleaned by a cleaning unit 9 to remove any adhering substance, such as toner (residual toner). It is also possible to collect any residual toner directly with the development element or any other component, thanks to the advent of clearnerless systems in recent years. The surface of the electrophotographic photosensitive member 1 is again used to form the image after the charge is removed through irradiation with pre-exposure light 10 emitted from a pre-exposure unit (not illustrated). When the charging unit 3 is a contact charging unit, i.e., a roller-based or similar charging unit, the pre-exposure unit may be unnecessary.

In an embodiment of the invention, two or more of these structural elements including the electrophotographic photosensitive member 1, the charging unit 3, the development unit 5, and the cleaning unit 9 may be integrally held in a container to form a process cartridge. This process cartridge may be configured to be detachably attached to the main body of an electrophotographic apparatus. For example, at least one selected from the charging unit 3, the development unit 5, the transfer unit 6, and the cleaning unit 9 and the electrophotographic photosensitive member 1 are integrally held and assembled into a cartridge, forming a process cartridge 11 that can be detachably attached to the main body of an electrophotographic apparatus using a guiding unit 12, such as rails, on the main body of the electrophotographic apparatus.

When the electrophotographic apparatus is a photocopier or a printing machine, the exposure light 4 may be a light reflected from or transmitted through the original document, and can also be a light emitted as a result of scanning with a laser beam, driving of an LED array or liquid-crystal shutter array, or similar processes performed according to a signal obtained by scanning the original document with a sensor and converting it into a digital image.

The electrophotographic photosensitive member 1 according to an embodiment of the invention also has a wide range of applications in the field of applied electrophotography, including laser beam printers, CRT printers, LED printers, fax machines, liquid-crystal printers, and laser platemaking.

EXAMPLES

The following describes certain aspects of the invention in further detail using examples and comparative examples. No aspect of the invention is limited to these examples while within the scope of the invention. The term "parts" in the following examples and comparative examples is based on mass unless otherwise specified.

Synthesis of Crystalline Gallium Phthalocyanines

Crystalline gallium phthalocyanines for use as charge generation materials were synthesized as follows.

Synthesis of Hydroxygallium Phthalocyanine Ga-0

Under a nitrogen flow in a reactor, 5.46 parts of phthalonitrile and 45 parts of α-chloronaphthalene were heated to 30° C. and maintained at this temperature. At the same temperature (30° C.), 3.75 parts of gallium trichloride was added. The water content of the liquid mixture at the addition of gallium trichloride was 150 ppm. The temperature was then increased to 200° C. The mixture was allowed to react at a temperature of 200° C. for 4.5 hours under a nitrogen flow and then cooled. When the temperature reached 150° C., the mixture containing the product was filtered. The residue was washed through dispersion in N,N-dimethylformamide at a temperature of 140° C. for 2 hours, and the obtained liquid dispersion was filtered. The residue was washed with ethanol and dried. This yielded 4.65 parts (71% yield) of chlorogallium phthalocyanine (ClGa).

The obtained ClGa, 4.65 parts, was dissolved in 139.5 parts of concentrated sulfuric acid at a temperature of 10° C. The resulting solution was added dropwise to 620 parts of iced water for reprecipitation, and the resulting mixture was filtered using a filter press. The obtained wet cake (residue) was washed through dispersion in 2% aqueous ammonia, and the resulting liquid dispersion was filtered using a filter press. The obtained wet cake (residue) was then purified through three cycles of dispersion and washing in ion-exchanged water and filtration using a filter press, yielding a hydroxygallium phthalocyanine pigment with a solids content of 23% (wet hydroxygallium phthalocyanine pigment).

Then 6.6 kg of the obtained hydroxygallium phthalocyanine pigment (wet hydroxygallium phthalocyanine pigment) was dried using HYPER-DRY HD-06R drying oven (Biocon (Japan); frequency (oscillation frequency), 2455 MHz±15 MHz) as follows.

A cake of the hydroxygallium phthalocyanine pigment freshly removed from the filter press (the thickness of the wet cake being 4 cm or less) was placed on a dedicated round plastic tray. The far-infrared radiation was off, and the temperature setting for the inner wall of the drying oven was 50° C. During the microwave irradiation, the vacuum pump and the leak valve were adjusted to keep the degree of vacuum in the range of 4.0 to 10.0 kPa.

In step 1, the hydroxygallium phthalocyanine pigment was irradiated with microwaves of 4.8 kW for 50 minutes. The microwaves were then turned off, and the leak valve was closed to make a high degree of vacuum of 2 kPa or less. The solids content of the hydroxygallium phthalocyanine pigment at this point was 88%. In step 2, the leak valve was adjusted to make the degree of vacuum (pressure in the drying oven) fall within the above parameter range (4.0 to 10.0 kPa). Then the hydroxygallium phthalocyanine pigment was irradiated with microwaves of 1.2 kW for 5 minutes. The microwaves were turned off, and the leak valve was closed to make a high degree of vacuum of 2 kPa or less. Step 2 was repeated once more (a total of twice). The solids content of the hydroxygallium phthalocyanine pigment at this point was 98%. In step 3, microwave irradiation was performed in the same way as in step 2 except that the microwave output power was changed from 1.2 kW to 0.8 kW. Step 3 was repeated once more (a total of twice). In step 4, the leak valve was adjusted to make the degree of vacuum (pressure in the drying oven) fall within the above parameter range (4.0 to 10.0 kPa) again. Then the hydroxygallium phthalocyanine pigment was irradiated with microwaves of 0.4 kW for 3 minutes. The microwaves were turned off, and the leak valve was closed to make a high degree of vacuum of 2 kPa or less. Step 4 was repeated seven more times (a total of eight times). This yielded 1.52 kg of a hydroxygallium phthalocyanine pigment (Ga-0) containing 1% or less water, taking a total of 3 hours.

Synthesis of Crystalline Gallium Phthalocyanine Ga-1

Figure 2:
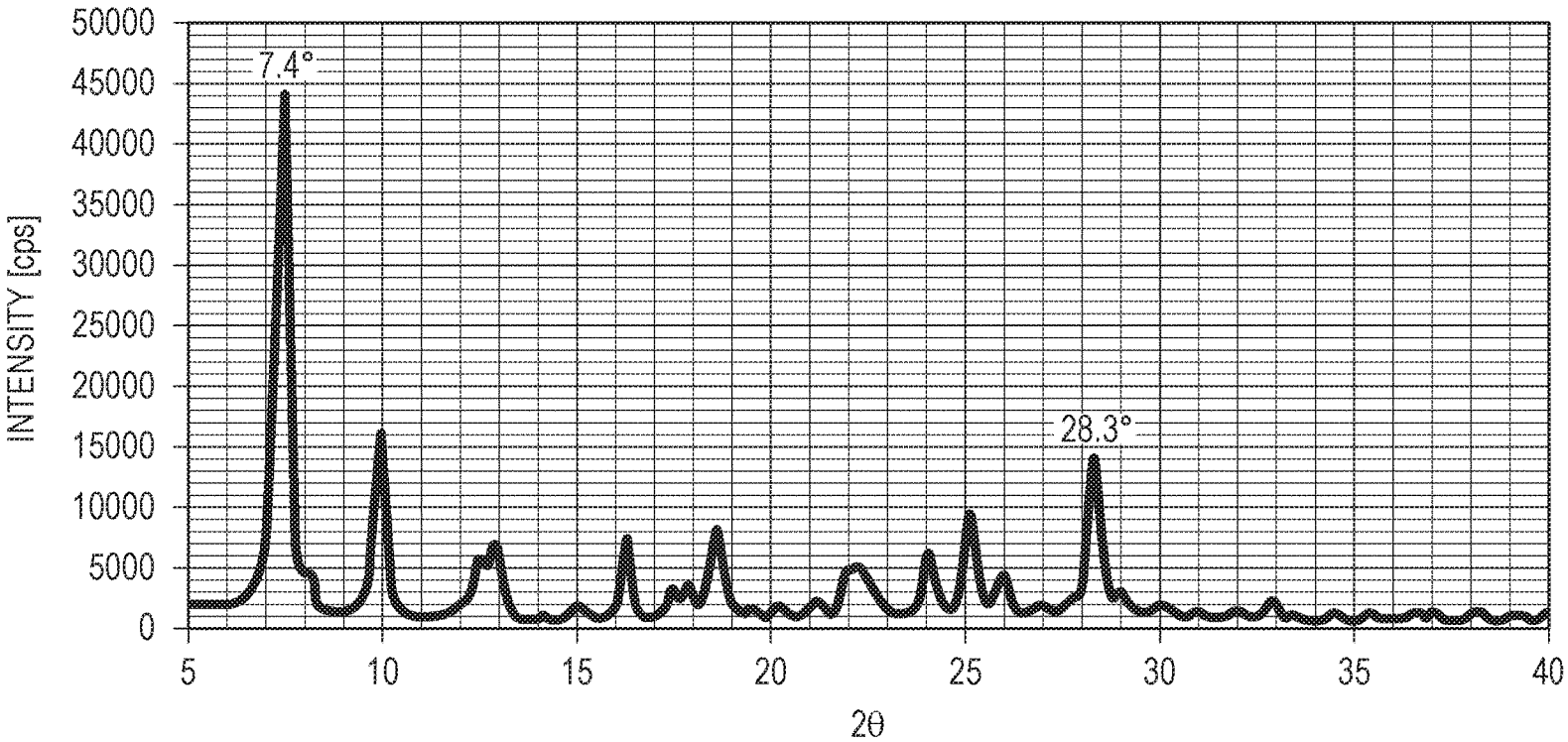
FIG. 2 is a powder X-ray diffraction pattern of a crystalline hydroxygallium phthalocyanine used in Examples.

In a ball mill, 0.5 parts of the obtained hydroxygallium phthalocyanine Ga-0 and 10 parts of N-methylformamide were milled with 20 parts of 0.8-mm diameter glass beads at room temperature (23° C.) and 120 rpm for 300 hours. Crystalline gallium phthalocyanine removed from this liquid dispersion using N,N-dimethylformamide was collected through filtration, and the surface of the filter was thoroughly washed with tetrahydrofuran. The residue was dried in vacuum, yielding 0.45 parts of crystalline hydroxygallium phthalocyanine Ga-1. FIG. 2 is a powder X-ray diffraction pattern of the obtained crystals.

$^{1}$H-NMR spectroscopy was performed using deuterated sulfuric acid as solvent [on AVANCE III 500 spectrometer (Bruker)], confirming that crystals of Ga-1 contained 0.9% by mass N-methylformamide.

Synthesis of Crystalline Gallium Phthalocyanine Ga-2

Crystalline gallium phthalocyanine was synthesized in the same way as in the synthesis of crystalline gallium phthalocyanine Ga-1, except that 10 parts of N-methylformamide was changed to 10 parts of N,N-dimethylformamide and the duration of milling was changed from 300 hours to 400 hours. This yielded 0.40 parts of crystalline hydroxygallium phthalocyanine Ga-2. The powder X-ray diffraction pattern of Ga-2 was similar to that in FIG. 2. NMR measurement demonstrated that crystals of Ga-2 contained 1.4% by mass N,N-dimethylformamide, as determined from the relative abundance of protons.

Synthesis of Crystalline Gallium Phthalocyanine Ga-3

Crystalline gallium phthalocyanine was synthesized in the same way as in the synthesis of crystalline gallium phthalocyanine Ga-1, except that 10 parts of N-methylformamide was changed to 10 parts of N,N-propylformamide and the duration of milling was changed from 300 hours to 500 hours. This yielded 0.40 parts of crystalline hydroxygallium phthalocyanine Ga-3. The powder X-ray diffraction pattern of Ga-3 was similar to that in FIG. 2. NMR measurement demonstrated that crystals of Ga-3 contained 1.4% by mass N-propylformamide, as determined from the relative abundance of protons.

Synthesis of Crystalline Gallium Phthalocyanine Ga-4

Crystalline gallium phthalocyanine was synthesized in the same way as in the synthesis of crystalline gallium phthalocyanine Ga-1, except that 10 parts of N-methylformamide was changed to 10 parts of N,N-vinylformamide and the duration of milling was changed from 300 hours to 100 hours. This yielded 0.40 parts of crystalline hydroxygallium phthalocyanine Ga-4. The powder X-ray diffraction pattern of Ga-4 was similar to that in FIG. 2. NMR measurement demonstrated that crystals of Ga-4 contained 1.8% by mass N-vinylformamide, as determined from the relative abundance of protons.

Synthesis of Crystalline Gallium Phthalocyanine Ga-5

Figure 3:
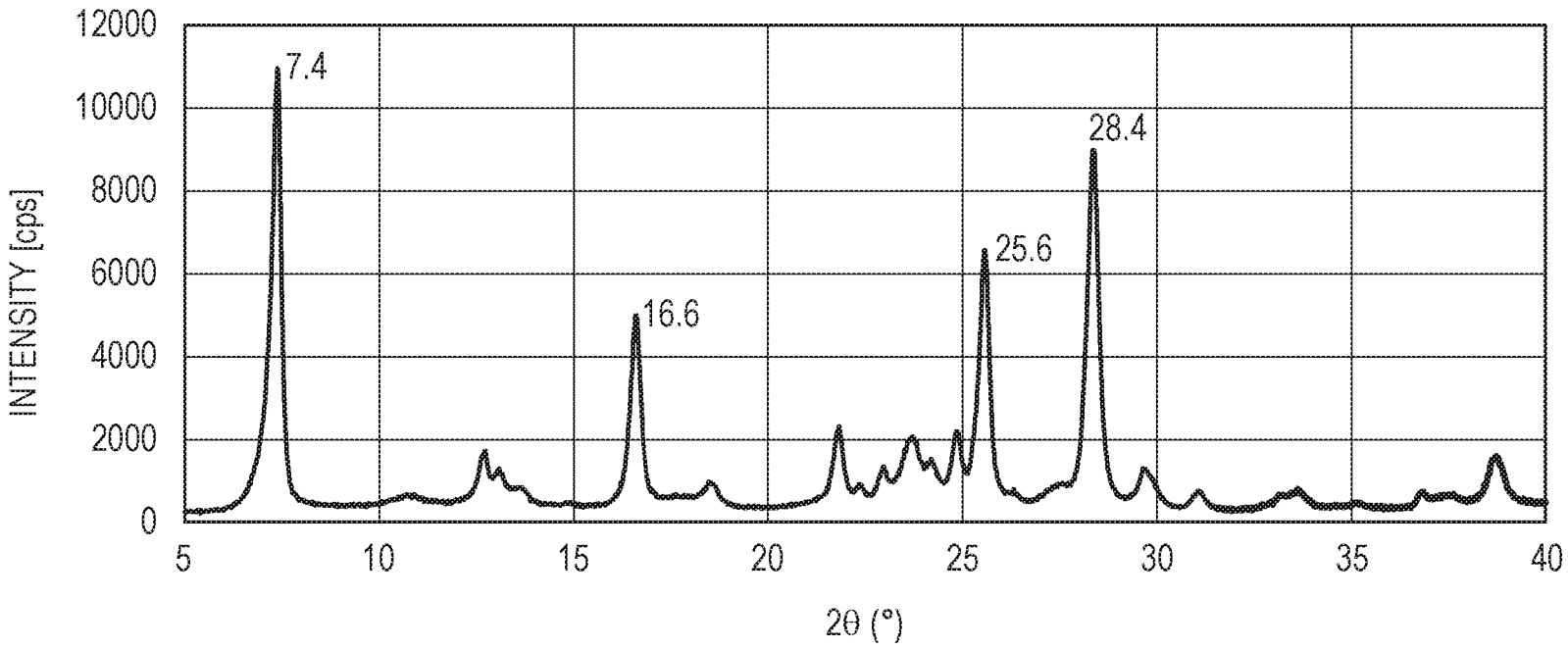
FIG. 3 is a powder X-ray diffraction pattern of a crystalline chlorogallium phthalocyanine used in Examples.

In a ball mill, 0.5 parts of the chlorogallium phthalocyanine (ClGa) obtained above was dry-milled with 20 parts of 0.8-mm diameter glass beads at room temperature (23° C.) for 40 hours. Ten parts of N,N-dimethylformamide was added, and wet-milling was performed at room temperature (23° C.) for 100 hours. Crystalline gallium phthalocyanine removed from this liquid dispersion using N,N-dimethylformamide was collected through filtration, and the surface of the filter was thoroughly washed with tetrahydrofuran. The residue was dried in vacuum, yielding 0.44 parts of crystalline chlorogallium phthalocyanine Ga-5. FIG. 3 is a powder X-ray diffraction pattern of the obtained crystals.

$^{1}$H-NMR spectroscopy was performed using deuterated sulfuric acid as solvent [on AVANCE III 500 spectrometer (Bruker)], confirming that crystals of Ga-5 contained 1.0% by mass N,N-dimethylformamide.

Synthesis of Crystalline Gallium Phthalocyanine Ga-6

Crystalline gallium phthalocyanine was synthesized in the same way as in the synthesis of crystalline gallium phthalocyanine Ga-2, except that the duration of milling was changed from 400 hours to 48 hours. This yielded 0.46 parts of crystalline hydroxygallium phthalocyanine Ga-6. NMR measurement demonstrated that crystals of Ga-6 contained 2.1% by mass N,N-dimethylformamide, as determined from the relative abundance of protons.

Synthesis of Crystalline Gallium Phthalocyanine Ga-7

Figure 4:
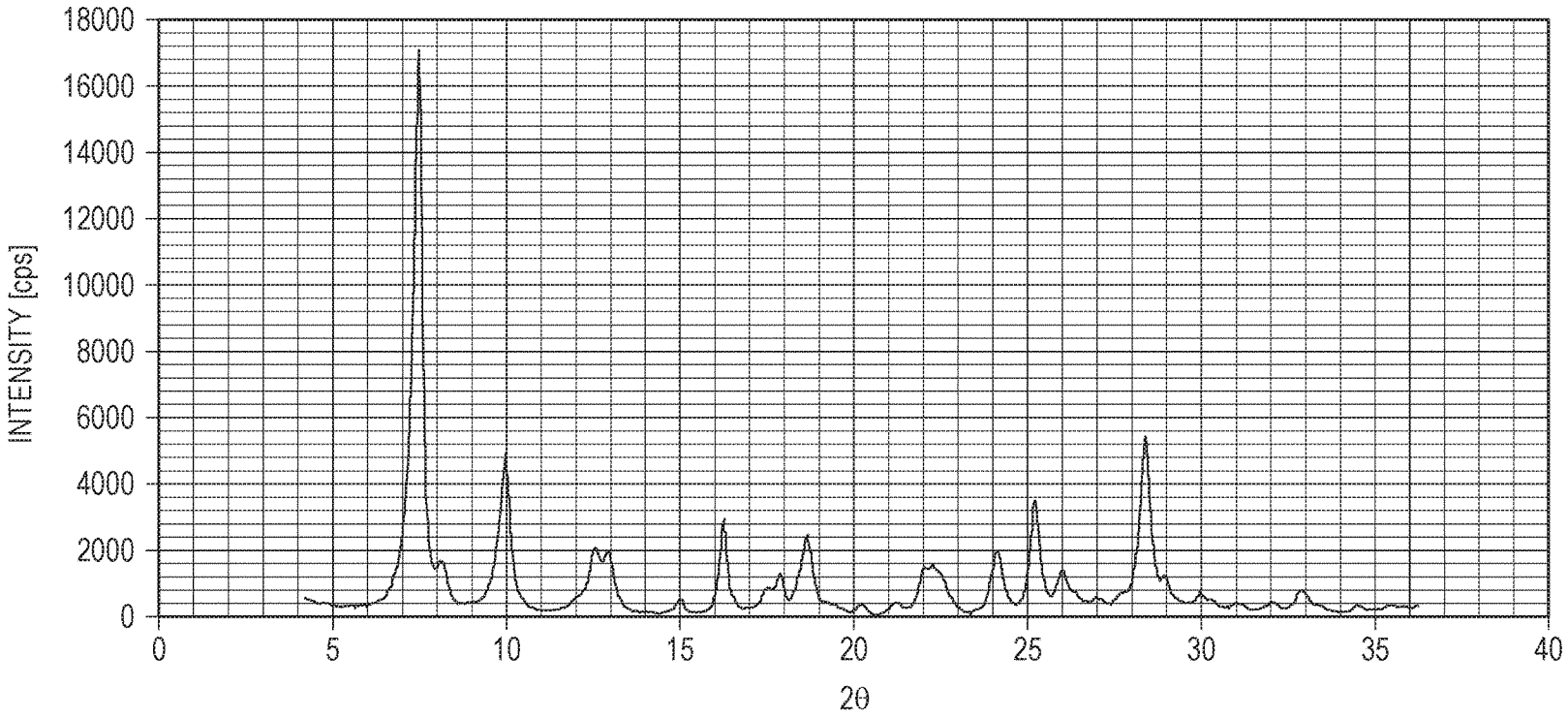
FIG. 4 is a powder X-ray diffraction pattern of a crystalline hydroxygallium phthalocyanine used in Examples.

Crystalline hydroxygallium phthalocyanine was synthesized in the same way as in the synthesis of crystalline gallium phthalocyanine Ga-1, except that 10 parts of N-methylformamide was changed to 10 parts of N,N-dimethylformamide and the duration of milling was changed from 300 hours to 100 hours. This yielded 0.40 parts of crystalline hydroxygallium phthalocyanine Ga-7. FIG. 4 is a powder X-ray diffraction pattern of the obtained crystals. NMR measurement demonstrated that crystals of Ga-7 contained 2.2% by mass N,N-dimethylformamide, as determined from the relative abundance of protons.

Production of Electrophotographic Photosensitive Members

In the following, the thickness of the individual layers of the electrophotographic photosensitive members is a measured value obtained using Fischerscope eddy-current coating thickness gauge (Fischer Instruments) or a calculated result based on the mass per unit area and the specific gravity.

Example 1

A solution composed of the following materials was subjected to 20 hours of dispersion in a ball mill: 60 parts of barium sulfate particles coated with tin oxide (trade name, Passtran PC1; Mitsui Mining & Smelting), 15 parts of titanium oxide particles (trade name, TITANIX JR; Tayca Corporation), 43 parts of resol-type phenolic resin (trade name, PHENOLITE J-325; DIC Corporation; solids content, 70% by mass), 0.015 parts of silicone oil (trade name, SH28PA; Dow Corning Toray), 3.6 parts of silicone resin (trade name, Tospearl 120; Toshiba Silicones), 50 parts of 1-methoxy-2-propanol, and 50 parts of methanol. In this way, a coating liquid for the formation of a conductive layer was prepared.

This coating liquid for the formation of a conductive layer was applied to an aluminum cylinder 261.5 mm long and 24 mm in diameter (JIS-A3003 aluminum alloy) for use as support by dip coating, and the obtained wet coating was dried at 140° C. for 30 minutes. In this way, a 30-μm thick conductive layer was formed.

Then 10 parts of copolymeric nylon resin (trade name, AMILAN CM8000; Toray) and 30 parts of methoxymethylated nylon 6 resin (trade name, Toresin EF-30T; Teikoku Kagaku Sangyo K.K.) were dissolved in a solvent mixture of 400 parts of methanol and 200 parts of n-butanol, producing a coating liquid for the formation of an undercoat layer. This coating liquid for the formation of an undercoat layer was applied to the conductive layer by dip coating, and the obtained wet coating was dried. In this way, a 0.8-μm thick undercoat layer (UCL-1) was formed.

Then 10 parts of crystalline gallium phthalocyanine Ga-7 (charge generation material), 5 parts of polyvinyl butyral resin (trade name, S-LEC BX-1; Sekisui Chemical), and 250 parts of cyclohexanone were subjected to 6 hours of dispersion in a sand mill with 1.0-mm diameter glass beads. This liquid dispersion was diluted with 250 parts of ethyl acetate, producing a coating liquid for the formation of a charge generation layer. This coating liquid for the formation of a charge generation layer was applied to the undercoat layer by dip coating, and the obtained wet coating was dried at 100° C. for 10 minutes. In this way, a 0.23-μm thick charge generation layer was formed.

Then 10 parts of exemplified compound 1921 (Mw: 50,000) as polycarbonate resin and 9 parts of a mixture of the compounds according to formulae (102) and (205) as charge transport materials (in a 9:1 mixing ratio) were dissolved in 70 parts of o-xylene (Xy) and 20 parts of dimethoxymethane (DMM), producing a coating liquid for the formation of a charge transport layer. This coating liquid for the formation of a charge transport layer was applied to the charge generation layer by dip coating, and the obtained wet coating was dried at 125° C. for 1 hour. In this way, a 20-μm thick charge transport layer was formed.

Examples 2 to 123 and Comparative Examples 1 to 6

Electrophotographic photosensitive members were produced, with changes made to the foregoing process (Example 1) in accordance with Tables 4 to 6 in terms of the following conditions: the use or omission of the conductive layer; the kind of the undercoat layer; the kind of charge generation material in the charge generation layer; the kind and weight-average molecular weight Mw of resin, the kind of charge transport material(s) (and the ratio by mass if two materials were used in combination), the amounts (parts) of the charge transport material(s) and the resin, and the kind and amount (parts) of solvent in the charge transport layer. Exemplified compound 3001 is a polymer (a weight-average molecular weight of 63,000) of group-B structural unit B-101 (a dielectric constant of 2.11). Exemplified compound 3002 is a polymer (a weight-average molecular weight of 53,000) of group-B structural unit B-201 (a dielectric constant of 2.20). Undercoat layers UCL-2 and UCL-3 and the charge generation layers containing charge generation material CGM-1 or CGM-2 were produced as follows.

Undercoat Layer UCL-2

Ten parts of the electron transport compound according to the following formula (ETM-1),

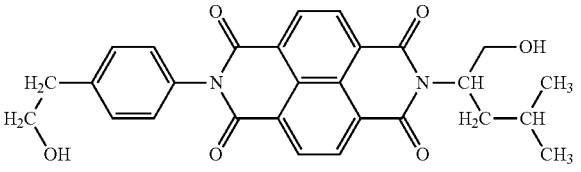

17 parts of the blocked isocyanate compound according to the following formula (trade name, Sumidur 3175; solids content, 75% by mass; Sumitomo Bayer Urethane) as a crosslinking agent,

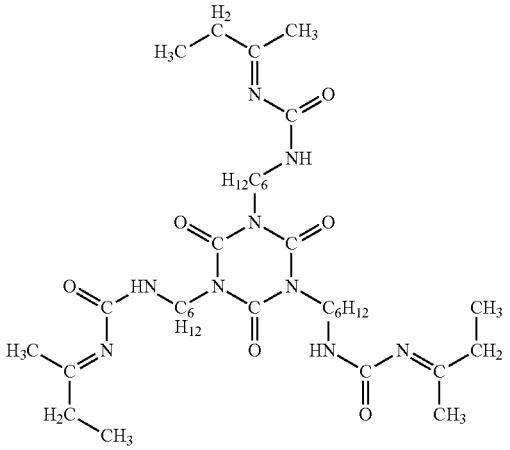

2 parts of polyvinyl butyral resin (trade name, S-LEC BX-1; Sekisui Chemical), and 0.2 parts of zinc (II) butyrate as an additive were dissolved in a solvent mixture of 100 parts of tetrahydrofuran and 100 parts of 1-methoxy-2-propanol, producing a coating liquid for the formation of an undercoat layer. This coating liquid for the formation of an undercoat layer was applied to the conductive layer by dip coating, and the obtained wet coating was heated at 160° C. for 30 minutes to dry and cure. In this way, a 0.7-μm thick undercoat layer UCL-2 was formed.

Undercoat Layer UCL-3

One hundred parts of zinc oxide particles (average primary particle diameter, 50 nm; specific surface area, 19 $m^2/g$; powder resistance, $4.7\times10^6$ Ω·cm; Tayca Corporation) was mixed into 500 parts of toluene with stirring. The resulting mixture was stirred with 1.25 parts of N-2-(aminoethyl)-3-aminopropylmethyldimethoxysilane (trade name, KBM602; Shin-Etsu Chemical) as a surface-treating agent for 6 hours. The toluene was then removed under reduced pressure, and the residue was dried at 130° C. for 6 hours, producing surface-treated zinc oxide particles. Then 75 parts of these surface-treated zinc oxide particles, 16 parts of the aforementioned blocked isocyanate compound (trade name, Sumidur 3175; solids content, 75% by mass; Sumitomo Bayer Urethane), 9 parts of polyvinyl butyral resin (trade name, S-LEC BM-1; Sekisui Chemical), and 1 part of 2,3,4-trihydroxybenzophenone (Tokyo Chemical Industry) were added to a solvent mixture of 60 parts of methyl ethyl ketone and 60 parts of cyclohexanone, producing a liquid dispersion. This liquid dispersion was subjected to 3 hours of dispersion in a vertical ball mill with glass beads having an average particle diameter of 1.0 mm in an atmosphere at 23° C. at a rotational speed of 1,500 rpm. After the completion of dispersion, the liquid dispersion was stirred with 5 parts of crosslinked methyl methacrylate particles (trade name, SSX-103; average particle diameter, 3 μm; Sekisui Chemical) and 0.01 parts of silicone oil (trade name, SH28PA; Dow Corning Toray), producing a coating liquid for the formation of an undercoat layer. This coating liquid for the formation of an undercoat layer was applied to the support by dip coating, and the obtained wet coating was heated at 160° C. for 40 minutes for polymerization. In this way, a 30-μm thick undercoat layer (UCL-3) was formed.

Charge Generation Layer Containing Charge Generation Material CGM-1

Twelve parts of a Y-form crystalline oxytitanium phthalocyanine (charge generation material) having a peak at a Bragg angle (2θ±0.2°) of 27.3° in its CuKα characteristic X-ray diffraction pattern, 10 parts of polyvinyl butyral resin (trade name, S-LEC BX-1; Sekisui Chemical), and 250 parts of cyclohexanone were subjected to 3 hours of dispersion in a ball mill with 1.0-mm diameter glass beads, producing a liquid dispersion. This liquid dispersion was diluted with 500 parts of ethyl acetate, producing a coating liquid for the formation of a charge generation layer. This coating liquid for the formation of a charge generation layer was applied to the undercoat layer by dip coating, and the obtained wet coating was dried at 80° C. for 10 minutes. In this way, a 0.20-μm thick charge generation layer was formed.

Charge Generation Layer Containing Charge Generation Material CGM-2

Fifteen parts of charge generation material CGM-2, which was the bisazo pigment according to the following formula,

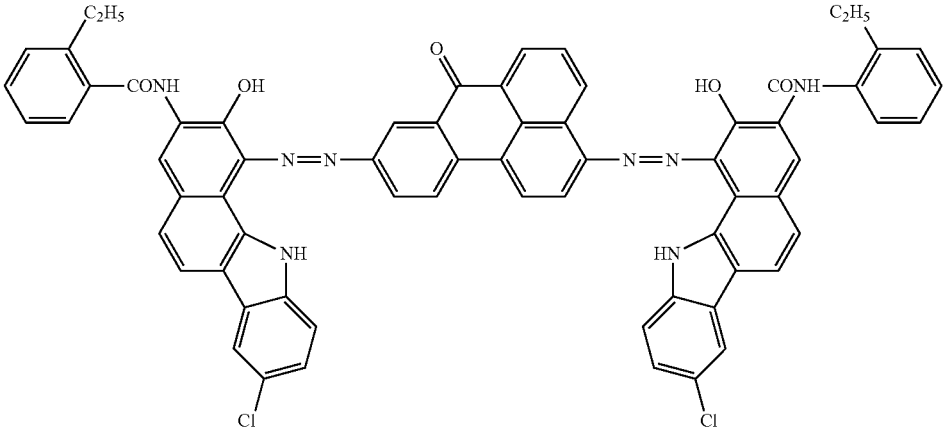

10 parts of polyvinyl butyral resin (trade name, S-LEC BX-1; Sekisui Chemical), and 250 parts of tetrahydrofuran were subjected to 3 hours of dispersion in a ball mill with 1.0-mm diameter glass beads, producing a liquid dispersion. This liquid dispersion was diluted with 100 parts of cyclohexanone and 500 parts of tetrahydrofuran, producing a coating liquid for the formation of a charge generation layer. This coating liquid for the formation of a charge generation layer was applied to the undercoat layer by dip coating, and the obtained wet coating was dried at 110° C. for 30 minutes. In this way, a 0.30-μm thick charge generation layer was formed.

TABLE 4

Conditions for the manufacture of photosensitive members

| Example No. | Conductive layer Used/ Not used | Undercoat layer Type | Charge generation layer Charge generation material | Charge transport layer: Resin Type | Resin Mw | Charge transport material(s) Type | Mass ratio | Charge transport material(s)/ resin in parts | Solvent(s) Type | Solvent(s) Parts |
|---|---|---|---|---|---|---|---|---|---|---|
| Example 1 | ○ | UCL-1 | Ga-7 | 1921 | 50000 | 102/205 | 9/1 | 9/10 | Xy/DMM | 70/20 |
| Example 2 | ○ | UCL-1 | Ga-7 | 1921 | 38000 | 102/205 | 9/1 | 9/10 | Xy/DMM | 70/20 |
| Example 3 | ○ | UCL-1 | Ga-7 | 1921 | 76000 | 102/205 | 9/1 | 9/10 | Xy/DMM | 70/20 |
| Example 4 | ○ | UCL-1 | Ga-7 | 1922 | 56000 | 102/205 | 9/1 | 9/10 | Xy/DMM | 70/20 |
| Example 5 | ○ | UCL-1 | Ga-7 | 1922 | 39000 | 102/205 | 9/1 | 9/10 | Xy/DMM | 70/20 |
| Example 6 | ○ | UCL-1 | Ga-7 | 1922 | 75000 | 102/205 | 9/1 | 9/10 | Xy/DMM | 70/20 |
| Example 7 | ○ | UCL-1 | Ga-7 | 1921 | 50000 | 102/205 | 9/1 | 6/10 | Xy/DMM | 70/20 |
| Example 8 | ○ | UCL-1 | Ga-7 | 1921 | 50000 | 102/305 | 9/1 | 9/10 | Xy/DMM | 70/20 |
| Example 9 | ○ | UCL-1 | Ga-7 | 1921 | 50000 | 102/201 | 9/1 | 9/10 | Xy/DMM | 70/20 |
| Example 10 | ○ | UCL-1 | Ga-7 | 1921 | 50000 | 405 | — | 9/10 | Xy/DMM | 70/20 |
| Example 11 | ○ | UCL-1 | Ga-7 | 1921 | 50000 | 302 | — | 9/10 | Xy/DMM | 70/20 |
| Example 12 | ○ | UCL-1 | Ga-7 | 1921 | 50000 | 705 | — | 9/10 | Xy/DMM | 70/20 |
| Example 13 | ○ | UCL-1 | Ga-7 | 1921 | 50000 | 603 | — | 9/10 | Xy/DMM | 70/20 |
| Example 14 | ○ | UCL-1 | Ga-7 | 1921 | 38000 | 603 | — | 9/10 | Xy/DMM | 70/20 |
| Example 15 | ○ | UCL-1 | Ga-7 | 1921 | 76000 | 603 | — | 9/10 | Xy/DMM | 70/20 |

TABLE 4-continued

| Conditions for the manufacture of photosensitive members | | | | | | | | | | |
|---|---|---|---|---|---|---|---|---|---|---|
| | | | Charge generation | Charge transport layer | | | | | | |
| | Conductive layer | Undercoat | layer Charge | | | Charge transport material(s) | | Charge transport | | |
| Example | Used/ | layer | generation | Resin | | | Mass | material(s)/ | Solvent(s) | |
| No. | Not used | Type | material | Type | Mw | Type | ratio | resin in parts | Type | Parts |
| Example 16 | ○ | UCL-1 | Ga-7 | 1922 | 56000 | 603 | — | 9/10 | Xy/DMM | 70/20 |
| Example 17 | ○ | UCL-1 | Ga-7 | 1922 | 39000 | 603 | — | 9/10 | Xy/DMM | 70/20 |
| Example 18 | ○ | UCL-1 | Ga-7 | 1922 | 75000 | 603 | — | 9/10 | Xy/DMM | 70/20 |
| Example 19 | ○ | UCL-1 | Ga-7 | 1921 | 50000 | 603 | — | 6/10 | Xy/DMM | 70/20 |
| Example 20 | ○ | UCL-1 | Ga-7 | 1921 | 50000 | 603 | — | 4/10 | Xy/DMM | 70/20 |
| Example 21 | ○ | UCL-1 | Ga-7 | 1921 | 50000 | 211 | — | 9/10 | Xy/DMM | 70/20 |
| Example 22 | ○ | UCL-1 | Ga-7 | 1921 | 50000 | 501 | — | 9/10 | Xy/DMM | 70/20 |
| Example 23 | ○ | UCL-1 | Ga-7 | 1921 | 50000 | 309 | — | 9/10 | Xy/DMM | 70/20 |
| Example 24 | ○ | UCL-1 | Ga-7 | 1921 | 50000 | 605 | — | 9/10 | Xy/DMM | 70/20 |
| Example 25 | ○ | UCL-1 | Ga-7 | 1921 | 38000 | 605 | — | 9/10 | Xy/DMM | 70/20 |
| Example 26 | ○ | UCL-1 | Ga-7 | 1921 | 76000 | 605 | — | 9/10 | Xy/DMM | 70/20 |
| Example 27 | ○ | UCL-1 | Ga-7 | 1922 | 56000 | 605 | — | 9/10 | Xy/DMM | 70/20 |
| Example 28 | ○ | UCL-1 | Ga-7 | 1922 | 39000 | 605 | — | 9/10 | Xy/DMM | 70/20 |
| Example 29 | ○ | UCL-1 | Ga-7 | 1922 | 75000 | 605 | — | 9/10 | Xy/DMM | 70/20 |
| Example 30 | ○ | UCL-1 | Ga-7 | 1921 | 50000 | 605 | — | 6/10 | Xy/DMM | 70/20 |
| Example 31 | ○ | UCL-1 | Ga-7 | 1921 | 50000 | 605 | — | 4/10 | Xy/DMM | 70/20 |
| Example 32 | ○ | UCL-1 | Ga-7 | 1921 | 50000 | 606 | — | 9/10 | Xy/DMM | 70/20 |
| Example 33 | ○ | UCL-1 | Ga-7 | 1921 | 50000 | 505 | — | 9/10 | Xy/DMM | 70/20 |
| Example 34 | ○ | UCL-1 | Ga-7 | 1921 | 50000 | 102/201 | 9/1 | 9/10 | Xy/DMM | 70/20 |
| Example 35 | ○ | UCL-1 | Ga-7 | 1921 | 50000 | 102/201 | 9/1 | 9/10 | Xy/DMM | 70/20 |
| Example 36 | ○ | UCL-2 | Ga-7 | 1921 | 50000 | 102/201 | 9/1 | 9/10 | Xy/DMM | 70/20 |
| Example 37 | — | UCL-3 | Ga-7 | 1921 | 50000 | 102/201 | 9/1 | 9/10 | Xy/DMM | 70/20 |
| Example 38 | ○ | UCL-1 | CGM-1 | 1921 | 50000 | 603 | — | 9/10 | Xy/DMM | 70/20 |
| Example 39 | ○ | UCL-1 | CGM-2 | 1921 | 50000 | 605 | — | 9/10 | Xy/DMM | 70/20 |
| Example 40 | ○ | UCL-1 | Ga-7 | 1921 | 50000 | 102/201 | 9/1 | 9/10 | THF | 90 |
| Example 41 | ○ | UCL-1 | Ga-7 | 1993 | 54000 | 102/201 | 9/1 | 9/10 | Xy/DMM | 70/20 |
| Example 42 | ○ | UCL-1 | Ga-7 | 1945 | 52000 | 102/205 | 9/1 | 9/10 | Xy/DMM | 70/20 |
| Example 43 | ○ | UCL-1 | Ga-7 | 1945 | 34000 | 102/205 | 9/1 | 9/10 | Xy/DMM | 70/20 |

TABLE 5

| Conditions for the manufacture of photosensitive members | | | | | | | | | | |
|---|---|---|---|---|---|---|---|---|---|---|
| | | | Charge generation | Charge transport layer | | | | | | |
| | Conductive layer | Undercoat | layer Charge | | | Charge transport material(s) | | Charge transport | | |
| Example | Used/ | layer | generation | Resin | | | Mass | meterial(s)/ | Solvent(s) | |
| No. | Not used | Type | material | Type | Mw | Type | ratio | resin in parts | Type | Parts |
| Example 44 | ○ | UCL-1 | Ga-7 | 1945 | 77000 | 102/205 | 9/1 | 9/10 | Xy/DMM | 70/20 |
| Example 45 | ○ | UCL-1 | Ga-7 | 1946 | 97000 | 102/205 | 9/1 | 9/10 | Xy/DMM | 70/20 |
| Example 46 | ○ | UCL-1 | Ga-7 | 1946 | 57000 | 102/205 | 9/1 | 9/10 | Xy/DMM | 70/20 |
| Example 47 | ○ | UCL-1 | Ga-7 | 1946 | 39000 | 102/205 | 9/1 | 9/10 | Xy/DMM | 70/20 |
| Example 48 | ○ | UCL-1 | Ga-7 | 1946 | 73000 | 102/205 | 9/1 | 9/10 | Xy/DMM | 70/20 |
| Example 49 | ○ | UCL-1 | Ga-7 | 1946 | 91000 | 102/205 | 9/1 | 9/10 | Xy/DMM | 70/20 |
| Example 50 | ○ | UCL-1 | Ga-7 | 1947 | 58000 | 102/205 | 9/1 | 9/10 | Xy/DMM | 70/20 |
| Example 51 | ○ | UCL-1 | Ga-7 | 1947 | 32000 | 102/205 | 9/1 | 9/10 | Xy/DMM | 70/20 |
| Example 52 | ○ | UCL-1 | Ga-7 | 1947 | 77000 | 102/205 | 9/1 | 9/10 | Xy/DMM | 70/20 |
| Example 53 | ○ | UCL-1 | Ga-7 | 1947 | 94000 | 102/205 | 9/1 | 9/10 | Xy/DMM | 70/20 |
| Example 54 | ○ | UCL-1 | Ga-7 | 1945 | 52000 | 102/205 | 9/1 | 6/10 | Xy/DMM | 70/20 |
| Example 55 | ○ | UCL-1 | Ga-7 | 1945 | 52000 | 211 | — | 9/10 | Xy/DMM | 70/20 |
| Example 56 | ○ | UCL-1 | Ga-7 | 1945 | 52000 | 211 | — | 6/10 | Xy/DMM | 70/20 |
| Example 57 | ○ | UCL-1 | Ga-7 | 1945 | 52000 | 211 | — | 4/10 | Xy/DMM | 70/20 |
| Example 58 | ○ | UCL-1 | Ga-7 | 1945 | 77000 | 307 | — | 9/10 | Xy/DMM | 70/20 |
| Example 59 | ○ | UCL-1 | Ga-7 | 1945 | 77000 | 307 | — | 6/10 | Xy/DMM | 70/20 |
| Example 60 | ○ | UCL-1 | Ga-7 | 1945 | 77000 | 307 | — | 4/10 | Xy/DMM | 70/20 |
| Example 61 | ○ | UCL-1 | CGM-1 | 1945 | 52000 | 558 | — | 9/10 | Xy/DMM | 70/20 |
| Example 62 | ○ | UCL-1 | Ga-7 | 1945 | 52000 | 558 | — | 9/10 | THF | 90 |
| Example 63 | ○ | UCL-1 | Ga-7 | 1948 | 52000 | 558 | — | 9/10 | THF | 90 |
| Example 64 | ○ | UCL-1 | Ga-7 | 2017 | 56000 | 102/205 | 9/1 | 9/10 | Xy/DMM | 70/20 |
| Example 65 | ○ | UCL-1 | Ga-7 | 1965 | 52000 | 102/205 | 9/1 | 9/10 | Xy/DMM | 70/20 |

TABLE 5-continued

| Conditions for the manufacture of photosensitive members | | | | | | | | | | |
|---|---|---|---|---|---|---|---|---|---|---|
| | | | Charge generation | Charge transport layer | | | | | | |
| | Conductive layer | Undercoat | layer Charge | | | Charge transport material(s) | | Charge transport | | |
| Example | Used/ | layer | generation | Resin | | | Mass | meterial(s)/ | Solvent(s) | |
| No. | Not used | Type | material | Type | Mw | Type | ratio | resin in parts | Type | Parts |
| Example 66 | ○ | UCL-1 | Ga-7 | 1965 | 34000 | 102/205 | 9/1 | 9/10 | Xy/DMM | 70/20 |
| Example 67 | ○ | UCL-1 | Ga-7 | 1965 | 70000 | 102/205 | 9/1 | 9/10 | Xy/DMM | 70/20 |
| Example 68 | ○ | UCL-1 | Ga-7 | 1965 | 98000 | 102/205 | 9/1 | 9/10 | Xy/DMM | 70/20 |
| Example 69 | ○ | UCL-1 | Ga-7 | 1966 | 59000 | 102/205 | 9/1 | 9/10 | Xy/DMM | 70/20 |
| Example 70 | ○ | UCL-1 | Ga-7 | 1966 | 39000 | 102/205 | 9/1 | 9/10 | Xy/DMM | 70/20 |
| Example 71 | ○ | UCL-1 | Ga-7 | 1966 | 73000 | 102/205 | 9/1 | 9/10 | Xy/DMM | 70/20 |
| Example 72 | ○ | UCL-1 | Ga-7 | 1966 | 92000 | 102/205 | 9/1 | 9/10 | Xy/DMM | 70/20 |
| Example 73 | ○ | UCL-1 | Ga-7 | 1967 | 55000 | 102/205 | 9/1 | 9/10 | Xy/DMM | 70/20 |
| Example 74 | ○ | UCL-1 | Ga-7 | 1967 | 39000 | 102/205 | 9/1 | 9/10 | Xy/DMM | 70/20 |
| Example 75 | ○ | UCL-1 | Ga-7 | 1967 | 70000 | 102/205 | 9/1 | 9/10 | Xy/DMM | 70/20 |
| Example 76 | ○ | UCL-1 | Ga-7 | 1967 | 99000 | 102/205 | 9/1 | 9/10 | Xy/DMM | 70/20 |
| Example 77 | ○ | UCL-1 | Ga-7 | 1965 | 52000 | 102/205 | 9/1 | 6/10 | Xy/DMM | 70/20 |
| Example 78 | ○ | UCL-1 | Ga-7 | 1965 | 52000 | 603 | — | 9/10 | Xy/DMM | 70/20 |
| Example 79 | ○ | UCL-1 | Ga-7 | 1965 | 52000 | 603 | — | 6/10 | Xy/DMM | 70/20 |
| Example 80 | ○ | UCL-1 | Ga-7 | 1965 | 52000 | 603 | — | 4/10 | Xy/DMM | 70/20 |
| Example 81 | ○ | UCL-1 | Ga-7 | 1965 | 70000 | 605 | — | 9/10 | Xy/DMM | 70/20 |
| Example 82 | ○ | UCL-1 | Ga-7 | 1965 | 70000 | 605 | — | 6/10 | Xy/DMM | 70/20 |
| Example 83 | ○ | UCL-1 | Ga-7 | 1965 | 70000 | 605 | — | 4/10 | Xy/DMM | 70/20 |
| Example 84 | ○ | UCL-1 | Ga-7 | 1965 | 52000 | 201 | — | 9/10 | THF | 90 |
| Example 85 | ○ | UCL-1 | Ga-7 | 1968 | 56000 | 201 | — | 9/10 | THF | 90 |
| Example 86 | ○ | UCL-1 | Ga-7 | 2037 | 52000 | 102/205 | 9/1 | 9/10 | Xy/DMM | 70/20 |

TABLE 6

| Conditions for the manufacture of photosensitive members | | | | | | | | | | |
|---|---|---|---|---|---|---|---|---|---|---|
| | | | Charge generation | Charge transport layer | | | | | | |
| | Conductive layer | Undercoat | layer Charge | | | Charge transport material(s) | | Charge transport | | |
| Example | Used/ | layer | generation | Resin | | | Mass | material(s)/ | Solvent(s) | |
| No. | Not used | Type | material | Type | Mw | Type | ratio | resin in parts | Type | Parts |
| Example 87 | ○ | UCL-1 | Ga-7 | 1949 | 58000 | 102/205 | 9/1 | 9/10 | Xy/DMM | 70/20 |
| Example 88 | ○ | UCL-1 | Ga-7 | 1949 | 33000 | 102/205 | 9/1 | 9/10 | Xy/DMM | 70/20 |
| Example 89 | ○ | UCL-1 | Ga-7 | 1949 | 77000 | 102/205 | 9/1 | 9/10 | Xy/DMM | 70/20 |
| Example 90 | ○ | UCL-1 | Ga-7 | 1949 | 91000 | 102/205 | 9/1 | 9/10 | Xy/DMM | 70/20 |
| Example 91 | ○ | UCL-1 | Ga-7 | 1950 | 55000 | 102/205 | 9/1 | 9/10 | Xy/DMM | 70/20 |
| Example 92 | ○ | UCL-1 | Ga-7 | 1950 | 30000 | 102/205 | 9/1 | 9/10 | Xy/DMM | 70/20 |
| Example 93 | ○ | UCL-1 | Ga-7 | 1950 | 79000 | 102/205 | 9/1 | 9/10 | Xy/DMM | 70/20 |
| Example 94 | ○ | UCL-1 | Ga-7 | 1950 | 95000 | 102/205 | 9/1 | 9/10 | Xy/DMM | 70/20 |
| Example 95 | ○ | UCL-1 | Ga-7 | 1951 | 50000 | 102/205 | 9/1 | 9/10 | Xy/DMM | 70/20 |
| Example 96 | ○ | UCL-1 | Ga-7 | 1951 | 35000 | 102/205 | 9/1 | 9/10 | Xy/DMM | 70/20 |
| Example 97 | ○ | UCL-1 | Ga-7 | 1951 | 80000 | 102/205 | 9/1 | 9/10 | Xy/DMM | 70/20 |
| Example 98 | ○ | UCL-1 | Ga-7 | 1951 | 90000 | 102/205 | 9/1 | 9/10 | Xy/DMM | 70/20 |
| Example 99 | ○ | UCL-1 | Ga-7 | 1949 | 58000 | 102/205 | 9/1 | 6/10 | Xy/DMM | 70/20 |
| Example 100 | ○ | UCL-1 | Ga-7 | 1949 | 58000 | 309 | — | 9/10 | Xy/DMM | 70/20 |
| Example 101 | ○ | UCL-1 | Ga-7 | 1949 | 58000 | 309 | — | 6/10 | Xy/DMM | 70/20 |
| Example 102 | ○ | UCL-1 | Ga-7 | 1949 | 58000 | 309 | — | 4/10 | Xy/DMM | 70/20 |
| Example 103 | ○ | UCL-1 | Ga-7 | 1949 | 77000 | 405 | — | 9/10 | Xy/DMM | 70/20 |
| Example 104 | ○ | UCL-1 | Ga-7 | 1949 | 77000 | 405 | — | 6/10 | Xy/DMM | 70/20 |
| Example 105 | ○ | UCL-1 | CGM-1 | 1949 | 58000 | 705 | — | 9/10 | Xy/DMM | 70/20 |
| Example 106 | ○ | UCL-1 | Ga-7 | 1949 | 58000 | 705 | — | 9/10 | THF | 90 |
| Example 107 | ○ | UCL-1 | Ga-7 | 1952 | 50000 | 705 | — | 9/10 | THF | 90 |
| Example 108 | ○ | UCL-1 | Ga-7 | 2021 | 50000 | 102/205 | 9/1 | 9/10 | Xy/DMM | 70/20 |
| Example 109 | ○ | UCL-1 | Ga-7 | 1973 | 59000 | 102/205 | 9/1 | 9/10 | Xy/DMM | 70/20 |
| Example 110 | ○ | UCL-1 | Ga-7 | 1973 | 34000 | 102/205 | 9/1 | 9/10 | Xy/DMM | 70/20 |
| Example 111 | ○ | UCL-1 | Ga-7 | 1973 | 74000 | 102/205 | 9/1 | 9/10 | Xy/DMM | 70/20 |
| Example 112 | ○ | UCL-1 | Ga-7 | 1973 | 93000 | 102/205 | 9/1 | 9/10 | Xy/DMM | 70/20 |
| Example 113 | ○ | UCL-1 | Ga-7 | 1974 | 56000 | 102/205 | 9/1 | 9/10 | Xy/DMM | 70/20 |
| Example 114 | ○ | UCL-1 | Ga-7 | 1974 | 39000 | 102/205 | 9/1 | 9/10 | Xy/DMM | 70/20 |
| Example 115 | ○ | UCL-1 | Ga-7 | 1974 | 70000 | 102/205 | 9/1 | 9/10 | Xy/DMM | 70/20 |

TABLE 6-continued

| Conditions for the manufacture of photosensitive members | | | | | | | | | | |
|---|---|---|---|---|---|---|---|---|---|---|
| | | | Charge generation | Charge transport layer | | | | | | |
| | Conductive layer | Undercoat | layer Charge | | | Charge transport material(s) | | Charge transport | | |
| Example | Used/ | layer | generation | Resin | | | Mass | material(s)/ | Solvent(s) | |
| No. | Not used | Type | material | Type | Mw | Type | ratio | resin in parts | Type | Parts |
| Example 116 | ○ | UCL-1 | Ga-7 | 1974 | 98000 | 102/205 | 9/1 | 9/10 | Xy/DMM | 70/20 |
| Example 117 | ○ | UCL-1 | Ga-7 | 1975 | 54000 | 102/205 | 9/1 | 9/10 | Xy/DMM | 70/20 |
| Example 118 | ○ | UCL-1 | Ga-7 | 1975 | 30000 | 102/205 | 9/1 | 9/10 | Xy/DMM | 70/20 |
| Example 119 | ○ | UCL-1 | Ga-7 | 1975 | 78000 | 102/205 | 9/1 | 9/10 | Xy/DMM | 70/20 |
| Example 120 | ○ | UCL-1 | Ga-7 | 1975 | 93000 | 102/205 | 9/1 | 9/10 | Xy/DMM | 70/20 |
| Example 121 | ○ | UCL-1 | Ga-7 | 1981 | 56000 | 102/205 | 9/1 | 9/10 | Xy/DMM | 70/20 |
| Example 122 | ○ | UCL-1 | Ga-7 | 2045 | 54000 | 102/205 | 9/1 | 9/10 | Xy/DMM | 70/20 |
| Example 123 | ○ | UCL-1 | Ga-7 | 2053 | 52000 | 102/205 | 9/1 | 9/10 | Xy/DMM | 70/20 |
| Example 124 | ○ | UCL-1 | Ga-1 | 1921 | 50000 | 102/205 | 9/1 | 9/10 | Xy/DMM | 70/20 |
| Example 125 | ○ | UCL-1 | Ga-2 | 1921 | 50000 | 102/205 | 9/1 | 9/10 | Xy/DMM | 70/20 |
| Example 126 | ○ | UCL-1 | Ga-3 | 1921 | 50000 | 102/205 | 9/1 | 9/10 | Xy/DMM | 70/20 |
| Example 127 | ○ | UCL-1 | Ga-4 | 1921 | 50000 | 102/205 | 9/1 | 9/10 | Xy/DMM | 70/20 |
| Example 128 | ○ | UCL-1 | Ga-5 | 1921 | 50000 | 102/205 | 9/1 | 9/10 | Xy/DMM | 70/20 |
| Comparative Example 1 | ○ | UCL-1 | Ga-7 | 3001 | 63000 | 102/205 | 9/1 | 9/10 | Xy/DMM | 70/20 |
| Comparative Example 2 | ○ | UCL-1 | Ga-7 | 3001 | 63000 | 102/205 | 9/1 | 9/10 | THF | 90 |
| Comparative Example 3 | ○ | UCL-1 | Ga-7 | 3002 | 53000 | 102/205 | 9/1 | 9/10 | Xy/DMM | 70/20 |
| Comparative Example 4 | ○ | UCL-1 | Ga-7 | 3002 | 53000 | 102/205 | 9/1 | 9/10 | THF | 90 |
| Comparative Example 5 | ○ | UCL-1 | Ga-7 | 2065 | 12000 | 102/205 | 9/1 | 9/10 | Xy/DMM | 70/20 |
| Comparative Example 6 | ○ | UCL-1 | Ga-7 | 2065 | 129000 | 102/205 | 9/1 | 9/10 | Xy/DMM | 70/20 |

Testing

The following tests were performed on the produced electrophotographic photosensitive members or coating liquids for the formation of a charge transport layer. The test results are summarized in Tables 7 to 9.

Testing of Coating Liquids for the Formation of a Charge Transport Layer

Storage Stability

After 24 hours of stirring following preparation, the coating liquid for the formation of a charge transport layer was stored for 1 month in a tightly sealed container under the conditions of a temperature of 23° C. and a relative humidity of 50%. The stored coating liquid for the formation of a charge transport layer was visually inspected, and the storage stability was evaluated according to the following criteria.

A: There were no undissolved solids, and the coating liquid was transparent.

B: There were no undissolved solids, but the coating liquid was slightly opaque.

C: There were no undissolved solids, but the coating liquid was noticeably opaque.

D: There were undissolved solids.

For the coating liquids for the formation of a charge transport layer with grade D storage stability, the following testing of an electrophotographic photosensitive member was impossible.

Testing of Electrophotographic Photosensitive Members Effect in the Reduction of Fog A CP-4525 laser beam printer (Hewlett Packard) was used as test apparatus after modifications to allow for the adjustment of the charging potential (dark-area potential) for the electrophotographic photosensitive member used therewith. The charging potential (dark-area potential) setting was −600 V.

The produced electrophotographic photosensitive members were each installed in a process cartridge (cyan) of the test apparatus. A test chart having a 1% image-recorded area was continuously printed on 10,000 sheets of A4 plain paper under the conditions of a temperature of 23° C. and a relative humidity of 50%, in 3-sheet batches with 6-second pauses between batches.

After this 30,000-sheet durability test, reflectometry was performed using a reflectometer (TC-6DS reflectometer, Tokyo Denshoku co., Ltd.) to determine the worst reflection density within the white background of the image, F1, and the mean baseline reflection density on plain paper, F0. The difference F1−F0 was defined as the fog level, with smaller fog levels meaning more effective reduction of fog. In these examples of the invention, grades AA to D in the criteria constituted favorable levels, whereas E an unacceptable level.

AA: The fog level was less than 1.0.

A: The fog level was 1.0 or more and less than 1.5.

B: The fog level was 1.5 or more and less than 2.0.

C: The fog level was 2.0 or more and less than 2.5.

D: The fog level was 2.5 or more and less than 5.0.

E: The fog level was 5.0 or more.

Sensitivity and Electrical Characteristics after Repeated Use

A CP-4525 laser beam printer (Hewlett Packard) was used as test apparatus after modifications to allow for the adjustment of the charging potential (dark-area potential) and the amount of exposure to light for the electrophotographic photosensitive member used therewith.

The produced electrophotographic photosensitive members were each installed in a process cartridge (cyan) of the test apparatus. A test chart having a 4% image-recorded area was continuously printed on 10,000 sheets of A4 plain paper under the conditions of a temperature of 23° C. and a relative humidity of 50%. The charging bias was adjusted so that the electrophotographic photosensitive member would be charged to −600 V (dark-area potential). The exposure conditions were adjusted so that the amount of exposure to light would be 0.4 ρJ/cm$^2$.

Before and after this process of repeated use, the light-area potential of the electrophotographic photosensitive member was measured as follows. The developing element was removed from the process cartridge of the test apparatus, and the light-area potential of the electrophotographic photosensitive member was measured using a surface potentiometer (Model 344, Trek) with a potential measurement probe (trade name, Model 6000B-8; Trek) placed at the point of development. The potential measurement probe was positioned in the middle of the longitudinal direction of the electrophotographic photosensitive member with a clearance of 3 mm between its measuring surface and the surface of the photosensitive member.

The obtained light-area potential of the electrophotographic photosensitive member before repeated use was used to evaluate the sensitivity of the photosensitive member. The higher the light-area potential of the electrophotographic photosensitive member before repeated use is, the more sensitive the photosensitive member is.

Furthermore, the change in the light-area potential of the electrophotographic photosensitive member from before to after repeated use (difference) was used to evaluate the electrical characteristics of the electrophotographic photosensitive member after repeated use. The smaller the change in light-area potential is, the better the electrical characteristics of the electrophotographic photosensitive member after repeated use are.

Response in Rapid Recording

Two test apparatuses X and Y were prepared. A CP-4525 laser beam printer (Hewlett Packard) was modified to allow for the adjustment of the charging potential (dark-area potential) and the amount of exposure to light for the electrophotographic photosensitive member used therewith and the development bias (test apparatus X). Test apparatus X was further modified to increase its process speed (rotational speed of the electrophotographic photosensitive member) by 1.5 times (test apparatus Y).

Figure 5:
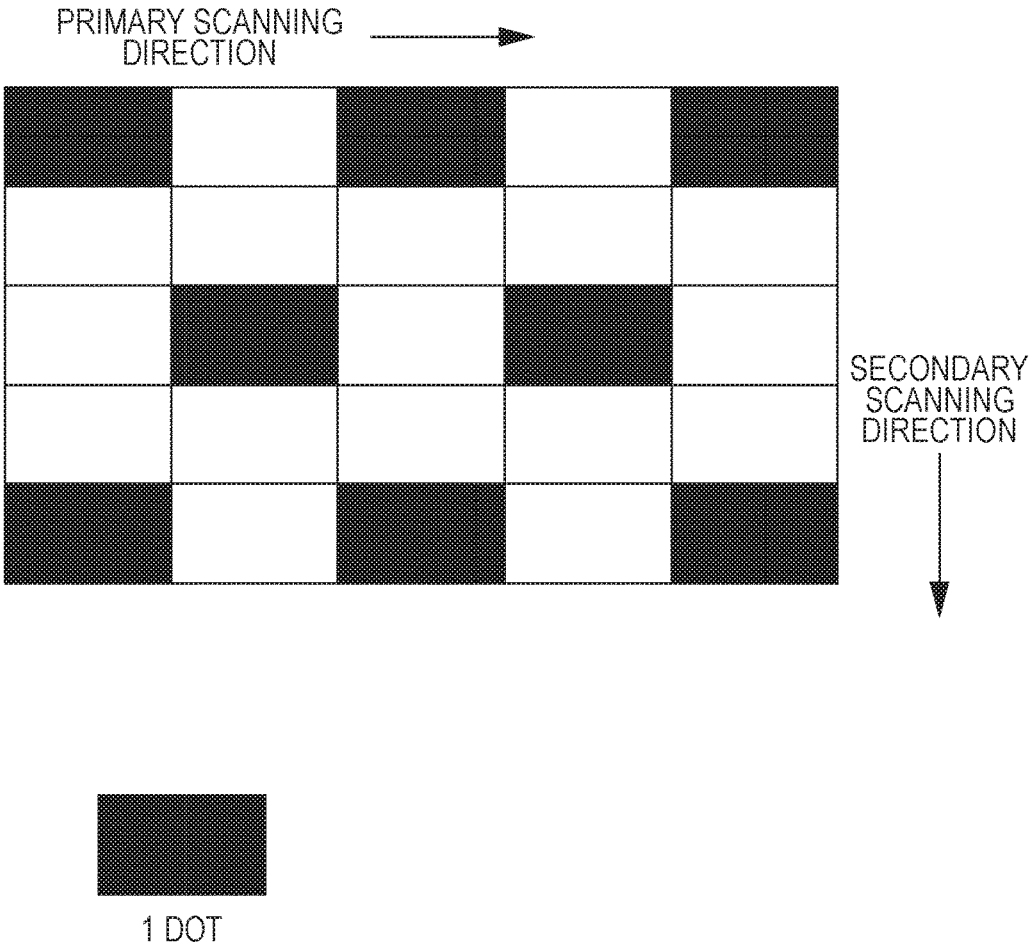
FIG. 5 is a diagram for describing a 1-dot "knight move in chess" pattern image.

The produced electrophotographic photosensitive members were each installed in a process cartridge (cyan) of each of test apparatuses X and Y. The 1-dot "knight move in chess" pattern halftone image illustrated in FIG. 5 was printed on A4 plain paper under the conditions of a temperature of 23° C. and a relative humidity of 50%, producing test images X and Y, respectively. The charging bias was adjusted so that the electrophotographic photosensitive member would be charged to −600 V (dark-area potential). The exposure conditions were adjusted so that the amount of exposure to light would be 0.4 μJ/cm$^2$. The development conditions were adjusted so that the development bias would be −350 V.

The difference in image density (Macbeth density) between test images X and Y measured with RD-918 densitometer (Macbeth) was used to evaluate response in rapid recording. To be more specific, on each test image, the reflection density in a 5-mm diameter circle was measured using an SPI filter at ten points in an area of image corresponding to one rotation of the electrophotographic photosensitive member, and the average among the ten points was used as the image density of the test image. The smaller the difference in image density is, the faster the response in rapid recording is. The criteria for evaluation were as follows.

A: The difference in image density was less than 0.02.

B: The difference in image density was 0.02 or more and less than 0.04.

C: The difference in image density was 0.04 or more and less than 0.06.

D: The difference in image density was 0.06 or more.

Long-Term Storage Stability

The produced electrophotographic photosensitive members were each installed in a process cartridge (cyan) of a CP-4525 laser beam printer (Hewlett Packard) and stored for 14 days under the conditions of a temperature of 60° C. and a relative humidity of 50%. The surface of the stored electrophotographic photosensitive member was observed using an optical microscope, and a test image was visually inspected. The results were used to evaluate long-term stability. The test image was printed using another CP-4525 laser beam printer, with the stored electrophotographic photosensitive member installed in its process cartridge (cyan). The criteria for evaluation were as follows.

A: No deposits were observed on the surface.

B: Some deposits were observed on the surface, but with no influence on image quality.

C: Many deposits were observed on the surface, but with no influence on image quality.

Effect in the Prevention of Photomemories

A CP-4525 laser beam printer (Hewlett Packard) was used as test apparatus after modifications to allow for the adjustment of the charging potential (dark-area potential) for the electrophotographic photosensitive member used therewith. The charging potential (dark-area potential) setting was −600 V.

The produced electrophotographic photosensitive members were each installed in a process cartridge (cyan) of the test apparatus. A halftone image was continuously printed on 10,000 sheets of A4 plain paper under the conditions of a temperature of 23° C. and a relative humidity of 50%. The electrophotographic photosensitive member was then removed from the process cartridge. The surface of the electrophotographic photosensitive member was then irradiated with light of 2,000 lux using a white fluorescent lamp for 10 minutes, with part of the surface shielded from the light along the circumferential direction. This electrophotographic photosensitive member was installed in another process cartridge (cyan), and the 1-dot "knight move in chess" pattern halftone image illustrated in FIG. 5 was printed 30 minutes after the completion of the irradiation with a fluorescent lamp. The areas of the halftone image corresponding to the light-shielded (unexposed) and non-light-shielded (exposed) portions were visually inspected, and the difference in image density was used to evaluate the effect in the prevention of photomemories. The criteria for evaluation were as follows.

A: No difference in density was observed.

B: There was a slight difference in density.

C: There was a difference in density, but not causing problems in practical use.

D: There was a difference in density, but with no clear boundary between the regions.

E: There was a noticeable difference in density, and the boundary between the regions was clear at least in part.

TABLE 7

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 1 | A | A | 138 | 41 | B | A | B |
| Example 2 | A | B | 142 | 45 | B | A | B |
| Example 3 | A | A | 145 | 35 | B | A | B |
| Example 4 | B | B | 118 | 42 | B | A | B |
| Example 5 | B | C | 124 | 37 | B | A | B |
| Example 6 | A | B | 126 | 35 | B | A | B |
| Example 7 | B | AA | 158 | 70 | C | A | B |
| Example 8 | A | A | 138 | 38 | B | A | B |
| Example 9 | A | A | 140 | 36 | B | A | B |
| Example 10 | A | B | 145 | 40 | B | A | B |
| Example 11 | A | B | 140 | 40 | B | A | B |
| Example 12 | A | B | 144 | 46 | B | A | B |
| Example 13 | A | A | 127 | 31 | B | A | C |
| Example 14 | A | B | 123 | 28 | B | B | C |
| Example 15 | A | A | 121 | 27 | B | B | C |
| Example 16 | B | B | 103 | 26 | A | B | C |
| Example 17 | B | C | 110 | 30 | A | B | C |
| Example 18 | B | B | 110 | 28 | A | B | C |
| Example 19 | B | AA | 136 | 36 | B | B | C |
| Example 20 | C | AA | 152 | 76 | C | A | B |
| Example 21 | A | A | 128 | 26 | B | B | C |
| Example 22 | A | A | 125 | 32 | B | B | C |
| Example 23 | A | A | 122 | 26 | B | B | C |
| Example 24 | A | A | 109 | 20 | A | C | D |
| Example 25 | A | B | 106 | 19 | A | C | D |
| Example 26 | A | A | 105 | 16 | A | C | D |
| Example 27 | B | B | 88 | 16 | A | C | D |
| Example 28 | B | C | 93 | 23 | A | C | D |
| Example 29 | B | B | 91 | 22 | A | C | D |
| Example 30 | C | AA | 128 | 26 | B | C | D |
| Example 31 | C | AA | 145 | 43 | B | A | C |
| Example 32 | A | A | 106 | 17 | A | C | D |
| Example 33 | A | A | 111 | 20 | A | C | D |
| Example 34 | A | A | 128 | 39 | B | A | B |
| Example 35 | A | A | 144 | 40 | B | A | B |
| Example 36 | A | A | 113 | 2 | B | A | B |
| Example 37 | A | A | 171 | 4 | B | A | B |
| Example 38 | A | B | 110 | 45 | B | B | D |
| Example 39 | A | A | 123 | 21 | A | C | D |
| Example 40 | A | B | 137 | 45 | B | A | B |
| Example 41 | A | A | 137 | 44 | B | A | B |
| Example 42 | A | B | 128 | 46 | A | A | A |
| Example 43 | A | C | 125 | 37 | A | A | A |

TABLE 8

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 44 | A | B | 129 | 44 | A | A | A |
| Example 45 | B | C | 128 | 36 | A | A | A |
| Example 46 | B | C | 117 | 45 | A | A | B |
| Example 47 | B | D | 112 | 38 | A | A | B |
| Example 48 | B | C | 114 | 39 | A | A | B |
| Example 49 | C | D | 117 | 44 | A | A | B |
| Example 50 | A | A | 135 | 40 | A | A | A |
| Example 51 | A | B | 129 | 46 | A | A | A |
| Example 52 | A | A | 127 | 39 | A | A | A |
| Example 53 | B | B | 127 | 35 | A | A | A |
| Example 54 | A | A | 139 | 79 | B | A | A |
| Example 55 | A | B | 113 | 27 | A | B | B |
| Example 56 | B | A | 123 | 40 | A | B | A |
| Example 57 | B | AA | 138 | 73 | B | A | A |
| Example 58 | A | B | 114 | 30 | A | B | B |

TABLE 8-continued

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 59 | B | A | 124 | 35 | A | B | A |
| Example 60 | B | AA | 136 | 59 | B | A | A |
| Example 61 | A | C | 113 | 37 | A | A | C |
| Example 62 | A | C | 120 | 46 | A | A | A |
| Example 63 | A | B | 134 | 42 | B | A | A |
| Example 64 | A | B | 122 | 35 | A | A | A |
| Example 65 | A | B | 130 | 41 | A | A | A |
| Example 66 | A | C | 126 | 45 | A | A | A |
| Example 67 | A | B | 120 | 41 | A | A | A |
| Example 68 | B | C | 122 | 38 | A | A | A |
| Example 69 | B | C | 121 | 47 | A | A | B |
| Example 70 | B | D | 111 | 42 | A | A | B |
| Example 71 | B | C | 116 | 42 | A | A | B |
| Example 72 | C | D | 112 | 47 | A | A | B |
| Example 73 | A | A | 129 | 44 | A | A | A |
| Example 74 | A | B | 128 | 37 | A | A | A |
| Example 75 | A | A | 125 | 38 | A | A | A |
| Example 76 | B | B | 133 | 41 | A | A | A |
| Example 77 | A | A | 145 | 72 | B | A | A |
| Example 78 | A | B | 105 | 28 | A | B | B |
| Example 79 | B | A | 120 | 35 | A | B | A |
| Example 80 | B | AA | 143 | 50 | B | A | A |
| Example 81 | A | B | 94 | 20 | A | C | C |
| Example 82 | B | A | 106 | 28 | A | C | C |
| Example 83 | C | AA | 121 | 36 | A | A | B |
| Example 84 | A | C | 122 | 36 | A | A | A |
| Example 85 | A | B | 138 | 43 | B | A | A |
| Example 86 | A | B | 124 | 44 | A | A | A |

TABLE 9

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 87 | A | B | 127 | 41 | B | A | A |
| Example 88 | A | C | 130 | 46 | B | A | A |
| Example 89 | A | B | 120 | 45 | B | A | A |
| Example 90 | B | C | 128 | 43 | B | A | A |
| Example 91 | B | C | 120 | 37 | A | A | B |
| Example 92 | B | D | 115 | 38 | A | A | B |
| Example 93 | B | C | 112 | 43 | A | A | B |
| Example 94 | C | D | 113 | 37 | A | A | B |
| Example 95 | A | A | 127 | 39 | B | A | A |
| Example 96 | A | B | 134 | 40 | B | A | A |
| Example 97 | A | A | 125 | 44 | B | A | A |
| Example 98 | B | B | 126 | 37 | B | A | A |
| Example 99 | A | A | 145 | 65 | B | A | A |
| Example 100 | A | B | 109 | 30 | A | B | B |
| Example 101 | B | A | 125 | 37 | B | B | B |
| Example 102 | B | AA | 142 | 56 | B | A | A |
| Example 103 | A | C | 125 | 42 | B | A | A |
| Example 104 | A | B | 141 | 74 | B | A | A |
| Example 105 | A | C | 108 | 35 | B | A | C |
| Example 106 | A | C | 126 | 39 | B | A | A |
| Example 107 | A | B | 139 | 37 | B | A | A |
| Example 108 | A | B | 120 | 43 | A | A | A |
| Example 109 | A | C | 113 | 44 | B | A | A |
| Example 110 | A | D | 109 | 44 | B | A | A |
| Example 111 | A | C | 115 | 38 | B | A | A |
| Example 112 | A | C | 114 | 41 | B | A | A |
| Example 113 | A | C | 110 | 43 | B | A | B |
| Example 114 | A | D | 108 | 35 | B | A | B |
| Example 115 | A | C | 113 | 44 | B | A | B |
| Example 116 | B | D | 106 | 40 | B | A | B |

TABLE 9-continued

| Test results | | | | | | | |
|---|---|---|---|---|---|---|---|
| | Coating | Electrophotographic photosensitive member | | | | | |
| Example No. | liquid Storage stability | Fog reduction | Sensitivity | Electrical characteristics after repeated use | Response in rapid recording | Long-term storage stability | Photomemory prevention |
| Example 117 | A | B | 113 | 35 | C | A | B |
| Example 118 | A | C | 113 | 38 | C | A | B |
| Example 119 | A | B | 114 | 44 | C | A | B |
| Example 120 | A | B | 112 | 47 | C | A | B |
| Example 121 | A | C | 109 | 40 | C | A | B |
| Example 122 | A | C | 105 | 39 | B | A | A |
| Example 123 | A | C | 111 | 44 | C | A | B |
| Example 124 | A | AA | 127 | 38 | B | A | B |
| Example 125 | A | AA | 131 | 42 | B | A | B |
| Example 126 | A | AA | 134 | 40 | B | A | B |
| Example 127 | A | AA | 139 | 43 | B | A | B |
| Example 128 | A | AA | 138 | 40 | B | A | B |
| Comparative Example 1 | D | — | — | — | — | — | — |
| Comparative Example 2 | D | — | — | — | — | — | — |
| Comparative Example 3 | D | — | — | — | — | — | — |
| Comparative Example 4 | D | — | — | — | — | — | — |
| Comparative Example 5 | A | F | 135 | 44 | A | A | B |
| Comparative Example 6 | D | — | — | — | — | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039429, filed Feb. 27, 2015, and No. 2016-026329 filed Feb. 15, 2016, which are hereby incorporated by reference herein in their entirety.

What is claimed is:

1. An electrophotographic photosensitive member comprising a support, a charge generation layer, and a charge transport layer in this order, the charge transport layer containing a charge transport material and a polycarbonate resin, the charge transport layer being a surface layer of the electrophotographic photosensitive member, wherein the polycarbonate resin has a structural unit A comprising formula (103), and a structural unit B comprising formula (104), (105), or (106), (103)

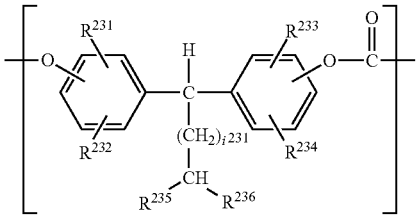

where $R^{231}$ to $R^{234}$ each independently represent a hydrogen atom or an alkyl, aryl, or alkoxy group, $R^{235}$ and $R^{236}$ are groups of the same kind, representing an alkyl group containing 1 to 9 carbon atoms, and $i^{231}$ represents an integer of 0 to 3;

(104)

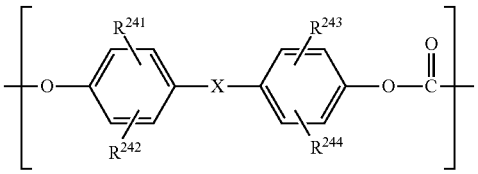

where $R^{241}$ to $R^{244}$ each independently represent a hydrogen atom or an alkyl, aryl, or alkoxy group, and X represents a single bond or a sulfonyl group;

(105)

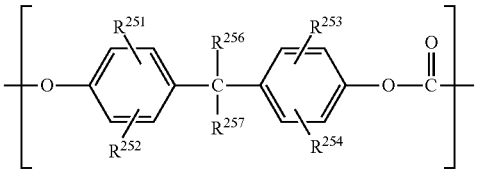

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

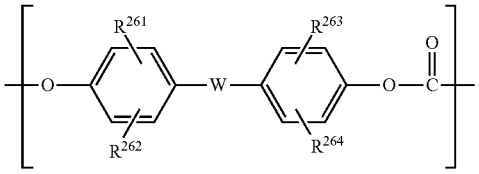

where $R^{261}$ to $R^{264}$ each independently represent a hydrogen atom or an alkyl, aryl, or alkoxy group, and W represents a cycloalkylidene group containing 5 to 12 carbon atoms, wherein the polycarbonate resin has a weight-average molecular weight of 30,000 or more and 100,000 or less, and a proportion of the structural unit A in the polycarbonate resin is 25 mol % or more and 49 mol % or less, wherein the relative dielectric constant E of the polycarbonate resin is 2.15 or less.

2. The electrophotographic photosensitive member according to claim 1, wherein the polycarbonate resin has a weight-average molecular weight of 40,000 or more and 80,000 or less.

3. The electrophotographic photosensitive member according to claim 1, wherein in the charge transport layer, a quantity of the charge transport material is 70% by mass or less of a quantity of the polycarbonate resin.

4. A method for manufacturing an electrophotographic photosensitive member, the electrophotographic photosensitive member having a support, a charge generation layer, and a charge transport layer in this order, the charge transport layer containing a charge transport material and a polycarbonate resin, the charge transport layer being a surface layer of the electrophotographic photosensitive member, wherein the polycarbonate resin has a structural unit A comprising formula (103), and a structural unit B comprising formula (104), (105), or (106), (103)

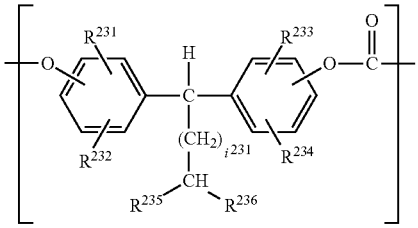

where $R^{231}$ to $R^{234}$ each independently represent a hydrogen atom or an alkyl, aryl, or alkoxy group, $R^{235}$ and $R^{236}$ are groups of the same kind, representing an alkyl group containing 1 to 9 carbon atoms, and $i^{231}$ represents an integer of 0 to 3;

(104)

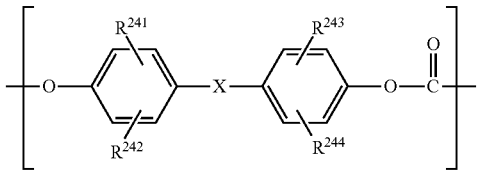

where $R^{241}$ to $R^{244}$ each independently represent a hydrogen atom or an alkyl, aryl, or alkoxy group, and X represents a single bond or a sulfonyl group;

(105)

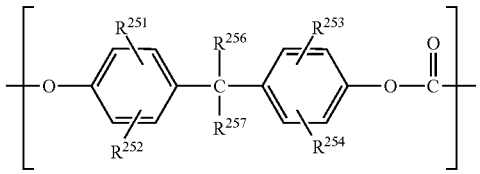

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

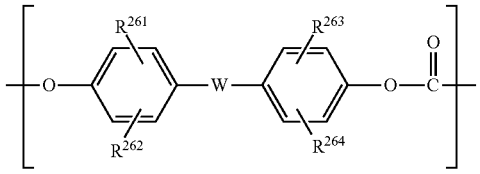

where $R^{261}$ to $R^{264}$ each independently represent a hydrogen atom or an alkyl, aryl, or alkoxy group, and W represents a cycloalkylidene group containing 5 to 12 carbon atoms, wherein the polycarbonate resin has a weight-average molecular weight of 30,000 or more and 100,000 or less, and a proportion of the structural unit A in the polycarbonate resin is 25 mol % or more and 49 mol % or less, wherein the relative dielectric constant E of the polycarbonate resin is 2.15 or less;

the method comprising:

producing the charge transport layer by forming a wet coating of a coating liquid configured to form the charge transport layer, the coating liquid containing the charge transport material, the polycarbonate resin, and a solvent having a dipole moment of 1.0 D or less; and drying the wet coating.

5. The method according to claim 4 for manufacturing an electrophotographic photosensitive member, wherein the solvent having a dipole moment of 1.0 D or less is one selected from xylene and methylal.

6. A process cartridge comprising an electrophotographic photosensitive member and at least one unit selected from the group consisting of a charging unit, a development unit, a transfer unit, and a cleaning unit, the process cartridge integrally holding the electrophotographic photosensitive member and the at least one unit and configured to be detachably attached to a main body of an electrophotographic apparatus, the electrophotographic photosensitive member having a support, a charge generation layer, and a charge transport layer in this order, the charge transport layer containing a charge transport material and a polycarbonate resin, the charge transport layer being a surface layer of the electrophotographic photosensitive member, wherein the polycarbonate resin has a structural unit A, comprising formula (103), and a structural unit B comprising formula (104, (105), or (106), (103)

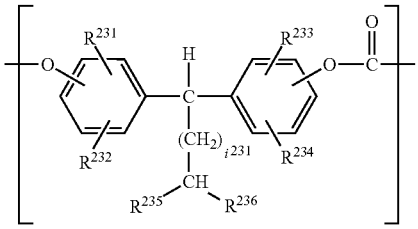

where $R^{231}$ to $R^{234}$ each independently represent a hydrogen atom or an alkyl, aryl, or alkoxy group, $R^{235}$ and $R^{236}$ are groups of the same kind, representing an alkyl group containing 1 to 9 carbon atoms, and $i^{231}$ represents an integer of 0 to 3;

(104)

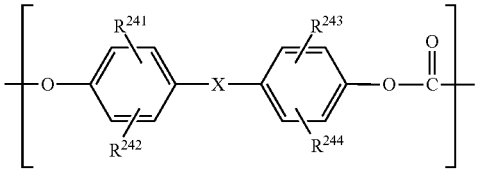

where $R^{241}$ to $R^{244}$ each independently represent a hydrogen atom or an alkyl, aryl, or alkoxy group, and X represents a single bond or a sulfonyl group;

(105)

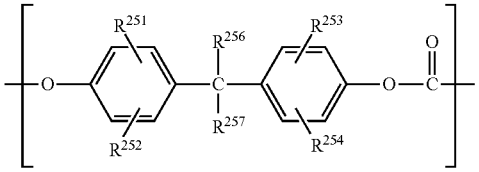

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

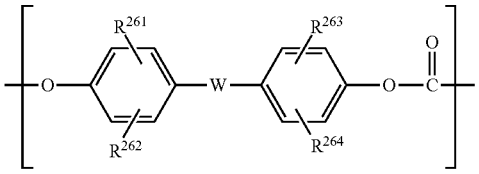

where $R^{261}$ to $R^{264}$ each independently represent a hydrogen atom or an alkyl, aryl, or alkoxy group, and W represents a cycloalkylidene group containing 5 to 12 carbon atoms, wherein the polycarbonate resin has a weight-average molecular weight of 30,000 or more and 100,000 or less, and a proportion of the structural unit A in the polycarbonate resin is 25 mol % or more and 49 mol % or less, wherein the relative dielectric constant E of the polycarbonate resin is 2.15 or less.

7. An electrophotographic apparatus comprising an electrophotographic photosensitive member and a charging unit, an exposure unit, a development unit, and a transfer unit, the electrophotographic photosensitive member having a support, a charge generation layer, and a charge transport layer in this order, the charge transport layer containing a charge transport material and a polycarbonate resin, the charge transport layer being a surface layer of the electrophotographic photosensitive member, wherein the polycarbonate resin has a structural unit A comprising formula (103), and a structural unit B comprising formula (104, (105), or (106), (103)

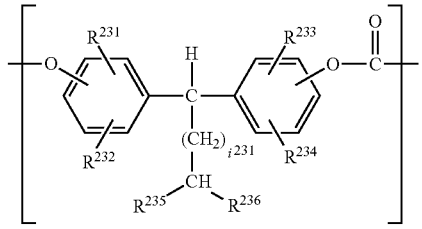

where $R^{231}$ to $R^{234}$ each independently represent a hydrogen atom or an alkyl, aryl, or alkoxy group, $R^{235}$ and $R^{236}$ are groups of the same kind, representing an alkyl group containing 1 to 9 carbon atoms, and $i^{231}$ represents an integer of 0 to 3;

(104)

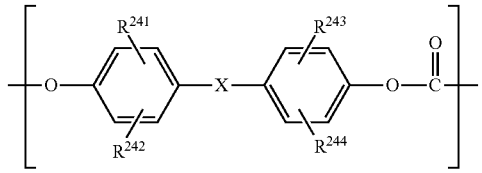

where $R^{241}$ to $R^{244}$ each independently represent a hydrogen atom or an alkyl, aryl, or alkoxy group, and X represents a single bond or a sulfonyl group;

(105)

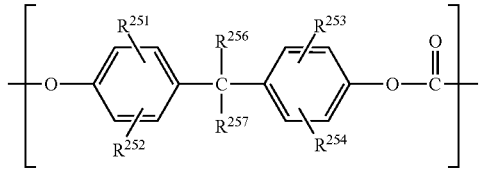

where $R^{251}$ to $R^{254}$ each independently represent a hydrogen atom or an alkyl, aryl, or alkoxy group, and $R^{256}$ and $R^{257}$ each independently represent a hydrogen atom or an alkyl, aryl, or halogenated alkyl group;

(106)

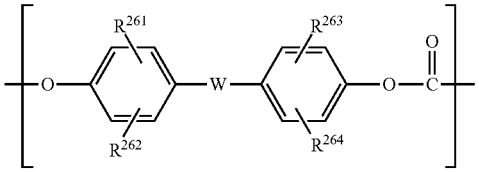

where $R^{261}$ to $R^{264}$ each independently represent a hydrogen atom or an alkyl, aryl, or alkoxy group, and W represents a cycloalkylidene group containing 5 to 12 carbon atoms, wherein the polycarbonate resin has a weight-average molecular weight of 30,000 or more and 100,000 or less, and a proportion of the structural unit A in the polycarbonate resin is 25 mol % or more and 49 mol % or less, wherein the relative dielectric constant E of the polycarbonate resin is 2.15 or less.

* * * * *